US008388390B2

(12) United States Patent
Kuriyagawa et al.

(10) Patent No.: US 8,388,390 B2
(45) Date of Patent: Mar. 5, 2013

(54) OUTBOARD MOTOR CONTROL APPARATUS

(75) Inventors: Koji Kuriyagawa, Saitama (JP); Hajime Yoshimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 115 days.

(21) Appl. No.: 13/114,631

(22) Filed: May 24, 2011

(65) Prior Publication Data

US 2011/0294370 A1 Dec. 1, 2011

(30) Foreign Application Priority Data

May 28, 2010 (JP) ..... 2010-123286
May 28, 2010 (JP) ..... 2010-123291

(51) Int. Cl.
*B63H 21/22* (2006.01)

(52) U.S. Cl. ..... 440/1; 440/61 S; 440/86

(58) Field of Classification Search ..... 440/1, 61 S, 440/86, 87
See application file for complete search history.

(56) References Cited

U.S. PATENT DOCUMENTS 5,142,473 A * 8/1992 Davis ..... 701/21
5,352,137 A * 10/1994 Iwai et al. ..... 440/1
5,366,393 A * 11/1994 Uenage et al. ..... 440/1
6,007,391 A 12/1999 Eilert
6,458,003 B1 10/2002 Krueger
7,238,071 B2 * 7/2007 Takada et al. ..... 440/84
7,243,009 B2 * 7/2007 Kaji ..... 701/21
7,416,456 B1 8/2008 Gonring et al.
7,617,026 B2 * 11/2009 Gee et al. ..... 701/21
2005/0272322 A1 12/2005 Mizuguchi et al.
2009/0209151 A1 8/2009 Suzuki et al.

FOREIGN PATENT DOCUMENTS

JP 2009-190671 A 8/2009

* cited by examiner

*Primary Examiner* — Stephen Avila
(74) *Attorney, Agent, or Firm* — Carrier Blackman & Associates, P.C.; William D. Blackman; Joseph P. Carrier

(57) ABSTRACT

In an apparatus for controlling operation of an outboard motor having an internal combustion engine, transmission and trim angle regulation mechanism, it is configured to change a gear position to the first speed when the gear position is in the second speed and a throttle opening change amount is at or above a predetermined value, start trim-up operation when the engine speed is at or above a first predetermined speed after the gear position is changed to the first speed, change the gear position from the first speed to the second speed when the engine speed is at or above a second predetermined speed after the trim-up operation is started, and stop the trim-up operation after the gear position is changed to the second speed. It can mitigate a deceleration feel generated when the gear position is changed upon the completion of the acceleration and prevent the pitching occurrence.

12 Claims, 21 Drawing Sheets

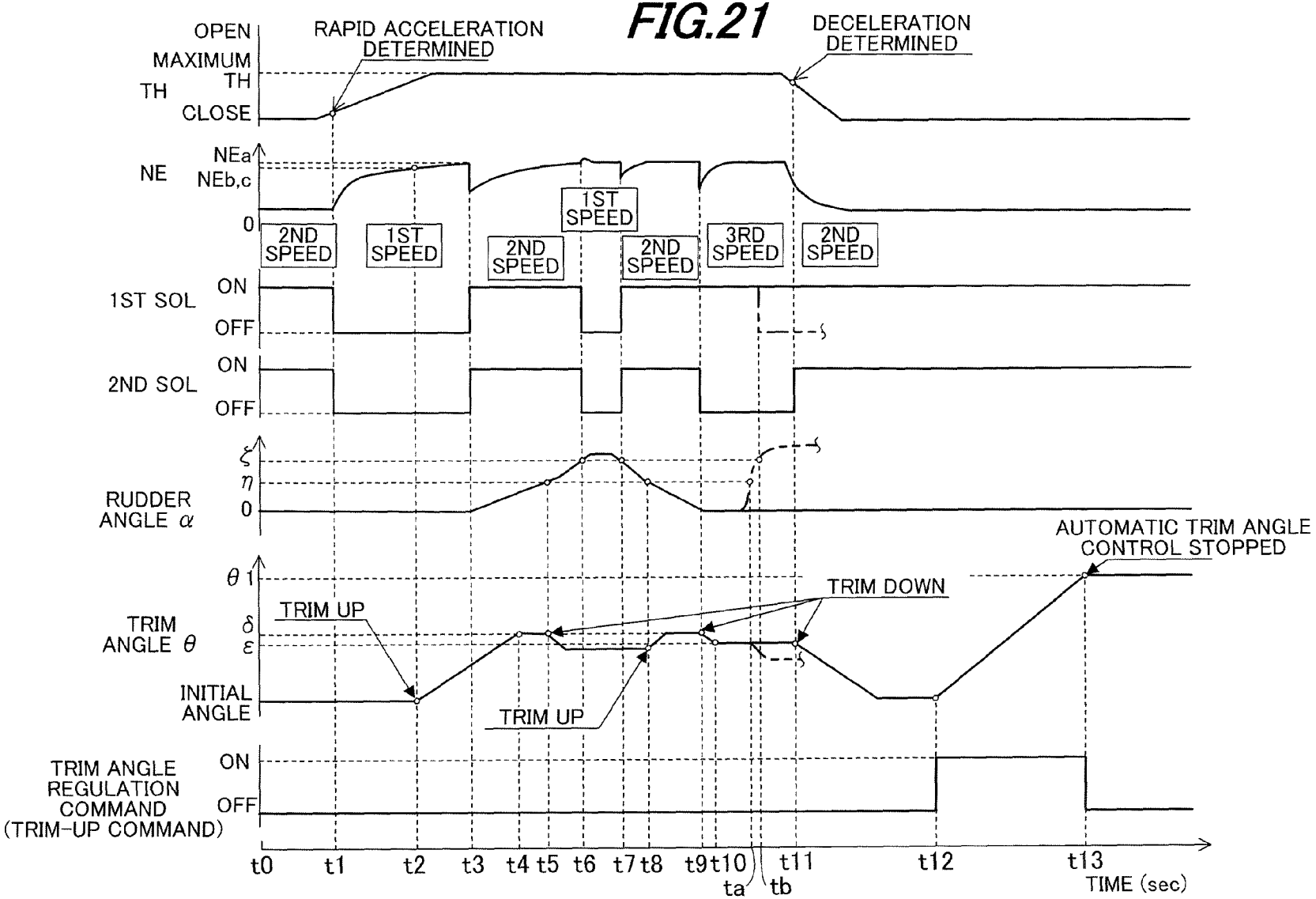
FIG.21
DECELERATION DETERMINED
RAPID ACCELERATION DETERMINED
AUTOMATIC TRIM ANGLE CONTROL STOPPED
OPEN
MAXIMUM TH
CLOSE
NE
NEa
NEb,c
0
2ND SPEED
1ST SPEED
2ND SPEED
1ST SPEED
2ND SPEED
3RD SPEED
2ND SPEED
1ST SOL
ON
OFF
2ND SOL
ON
OFF
RUDDER ANGLE α
ζ
η
0
TRIM ANGLE θ
θ1
δ
ε
TRIM UP
TRIM DOWN
TRIM UP
INITIAL ANGLE
TRIM ANGLE REGULATION COMMAND (TRIM-UP COMMAND)
ON
OFF
t0
t1
t2
t3
t4
t5
t6
t7
t8
t9
t10
ta
t11
tb
t12
t13
TIME (sec)

OUTBOARD MOTOR CONTROL APPARATUS

BACKGROUND OF THE INVENTION

1. Technical Field

This invention relates to an outboard motor control apparatus, particularly to an apparatus for controlling an outboard motor with a transmission.

2. Background Art

In recent years, there is proposed a technique for an outboard motor having a transmission interposed at a power transmission shaft between an internal combustion engine and a propeller to transmit an output of the engine to the propeller, as taught, for example, by Japanese Laid-Open Patent Application No. 2009-190671. In the reference, when the boat is accelerated through the manipulation of a throttle lever by the operator, a gear position (ratio) of the transmission is changed from the second speed to the first speed to amplify torque to be transmitted to the propeller, thereby improving the acceleration performance, and subsequently when the engine speed is increased so that the acceleration is completed, the gear position is returned from the first speed to the second speed.

SUMMARY OF INVENTION

In the case where the gear position is changed from the first speed to the second speed upon the completion of the acceleration as in the reference, since the torque amplification through the transmission is stopped, the torque to be transmitted to the propeller is decreased accordingly and it sometimes gives a deceleration feel to the operator.

To cope with it, it can be considered that the trim-up operation is conducted to regulate the trim angle to a predetermined angle to increase the boat speed before the gear position is changed to the second speed, thereby mitigating the deceleration feel. However, since the predetermined angle is set beforehand, it may cause excessive trim-up operation depending on size of the boat, resulting in occurrence of a failure such as pitching (vibration or shake in the vertical direction) of the boat, disadvantageously.

An object of this invention is therefore to overcome the foregoing problem by providing an apparatus for controlling an outboard motor having a transmission, which apparatus can mitigate a deceleration feel generated when the gear position is changed upon the completion of the acceleration and prevent the pitching occurrence caused by the excessive trim-up operation.

In order to achieve the object, this invention provides in the first aspect an apparatus for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising: a throttle opening change amount detector adapted to detect a change amount of throttle opening of the engine; an engine speed detector adapted to detect speed of the engine; a first-speed changer adapted to change the gear position of the transmission from the second speed to the first speed when the gear position is in the second speed and the detected change amount of the throttle opening is equal to or greater than a predetermined value; a trim-up starter adapted to start the trim-up operation through the trim angle regulation mechanism when the detected engine speed is equal to or greater than a first predetermined speed after the gear position is changed to the first speed by the first-speed changer; a second-speed changer adapted to change the gear position from the first speed to the second speed when the detected engine speed is equal to or greater than a second predetermined speed set greater than the first predetermined speed after the trim-up operation is started by the trim-up starter; and a trim-up stopper adapted to stop the trim-up operation after the gear position is changed to the second speed by the second-speed changer.

In order to achieve the object, this invention provides in the second aspect a method for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising the steps of: detecting a change amount of throttle opening of the engine; detecting speed of the engine; changing the gear position of the transmission from the second speed to the first speed when the gear position is in the second speed and the detected change amount of the throttle opening is equal to or greater than a predetermined value; starting the trim-up operation through the trim angle regulation mechanism when the detected engine speed is equal to or greater than a first predetermined speed after the gear position is changed to the first speed; changing the gear position from the first speed to the second speed when the detected engine speed is equal to or greater than a second predetermined speed set greater than the first predetermined speed after the trim-up operation is started by the step of trim-up starting; and stopping the trim-up operation after the gear position is changed to the second speed.

BRIEF DESCRIPTION OF DRAWINGS

The above and other objects and advantages of the invention will be more apparent from the following description and drawings in which:

FIG. 21 is a time chart for explaining the operation of the flowcharts in FIGS. 12 to 20.

DESCRIPTION OF EMBODIMENTS

Embodiments of an outboard motor control apparatus according to the invention will now be explained with reference to the attached drawings.

Figure 1:
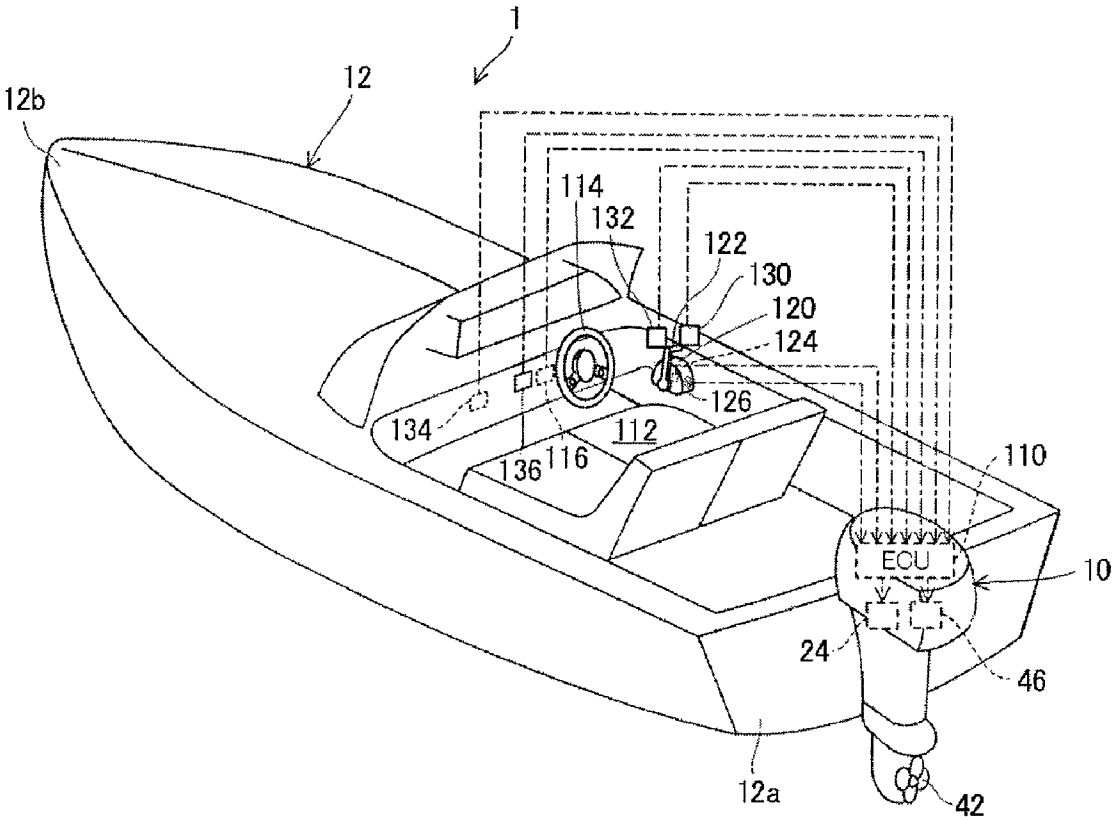
FIG. 1 is an overall schematic view of an outboard motor control apparatus including a boat according to a first embodiment of the invention.
Figure 2:
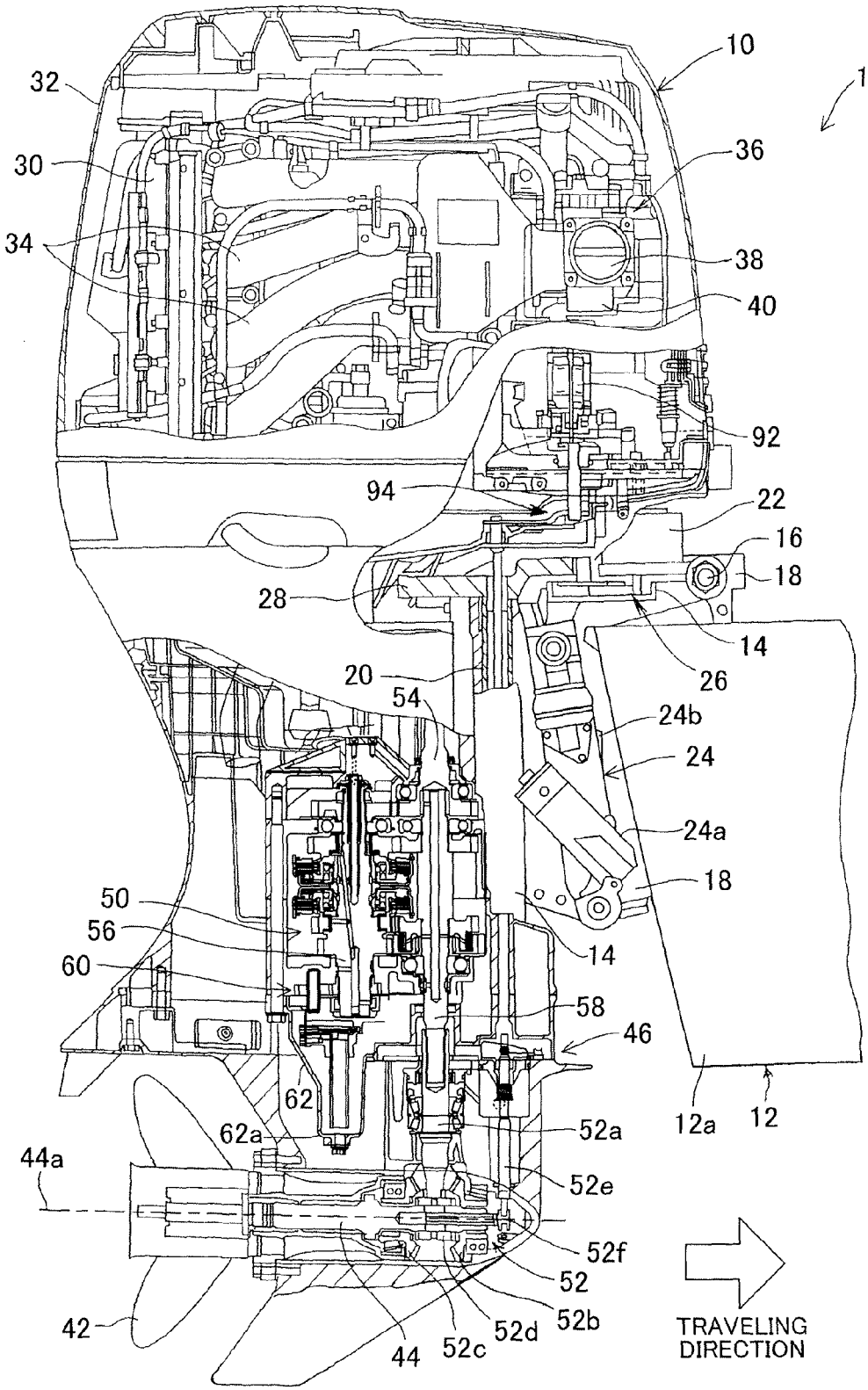
FIG. 2 is an enlarged sectional side view partially showing the outboard motor shown in FIG. 1.

FIG. 1 is an overall schematic view of an outboard motor control apparatus including a boat according to a first embodiment of the invention. FIG. 2 is an enlarged sectional side view partially showing the outboard motor shown in FIG. 1 and FIG. 3 is an enlarged side view of the outboard motor.

Figure 3:
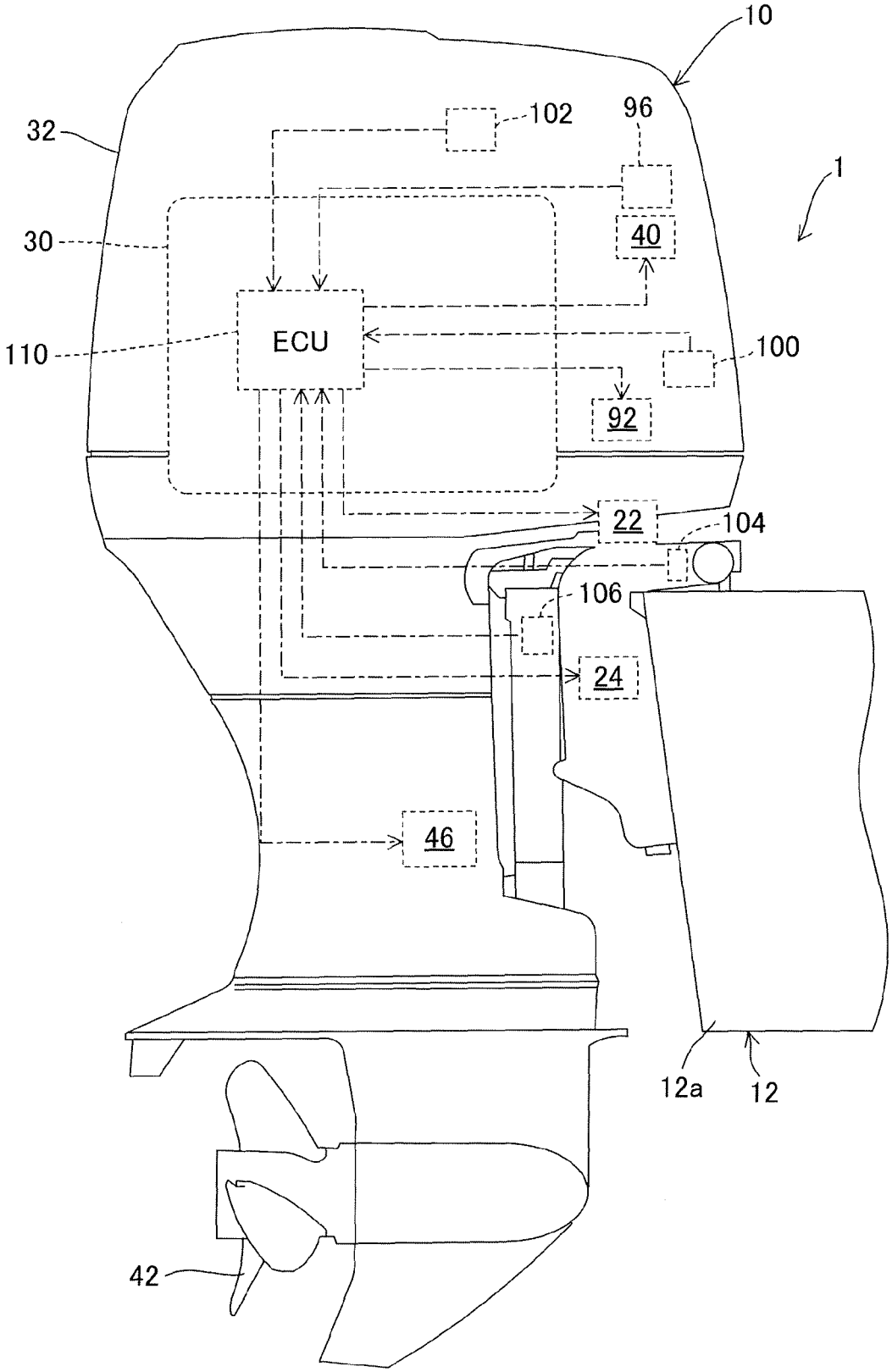
FIG. 3 is an enlarged side view of the outboard motor shown in FIG. 1.

In FIGS. 1 to 3, a symbol 1 indicates a boat or vessel whose hull 12 is mounted with the outboard motor 10. As clearly shown in FIG. 2, the outboard motor 10 is clamped (fastened) to the stern or transom 12*a* of the boat 1, more precisely, to the stern 12*a* of the hull 12 through a swivel case 14, tilting shaft 16 and stern brackets 18.

An electric steering motor (actuator) 22 for operating a shaft 20 which is housed in the swivel case 14 to be rotatable about the vertical axis and a power tilt-trim unit (actuator; trim angle regulation mechanism; hereinafter called the "trim unit") 24 for regulating a tilt angle and trim angle of the outboard motor 10 relative to the boat 1 (i.e., hull 12) by tilting up/down and trimming up/down are installed near the swivel case 14. A rotational output of the steering motor 22 is transmitted to the shaft 20 via a speed reduction gear mechanism 26 and mount frame 28, whereby the outboard motor 10 is steered about the shaft 20 as a steering axis to the right and left directions (steered about the vertical axis).

The trim unit 24 integrally comprises a hydraulic cylinder 24*a* for adjusting the tilt angle and a hydraulic cylinder 24*b* for adjusting the trim angle. In the trim unit 24, the hydraulic cylinders 24*a*, 24*b* are extended/contracted so that the swivel case 14 is rotated about the tilting shaft 16 as a rotational axis, thereby tiling up/down and trimming up/down the outboard motor 10. The hydraulic cylinders 24*a*, 24*b* are connected to a hydraulic circuit (not shown) in the outboard motor 10 and extended/contracted upon being supplied with operating oil therethrough. Since both the tilt angle and trim angle are values indicating rotation angles of the main body of the outboard motor 10 about the tilting shaft 16 as the rotational axis, they are simply called the "trim angle" in the following.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control an engine speed of the engine 30.

The outboard motor 10 further comprises a propeller shaft (power transmission shaft) 44 that is supported to be rotatable about the horizontal axis and attached with a propeller 42 at its one end to transmit power output of the engine 30 thereto, and a transmission 46 that is interposed at a location between the engine 30 and propeller shaft 44 and has a plurality of gear positions, i.e., first, second and third speeds.

The propeller shaft 44 is positioned so that its axis line 44*a* is substantially parallel to the traveling direction of the boat 1 in the initial condition of the trim unit 24 (condition where the trim angle θ is at the initial angle). The transmission 46 comprises a transmission mechanism 50 that is selectively changeable in gear positions and a shift mechanism 52 that can change a shift position among forward, reverse and neutral positions.

Figure 4:
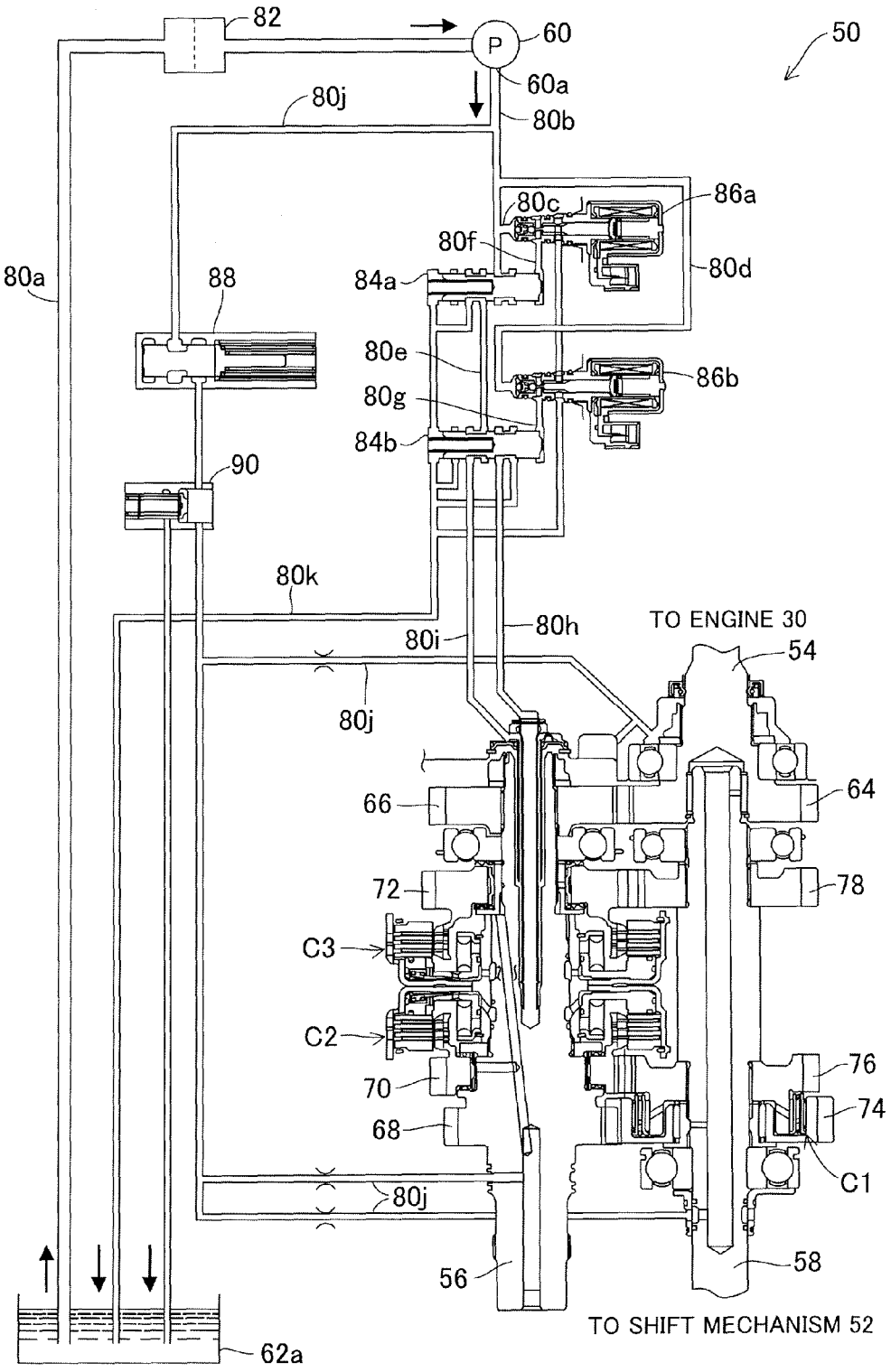
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (ratios), which includes an input shaft (drive shaft) 54 connected to the crankshaft (not shown in the figures) of the engine 30, a countershaft 56 connected to the input shaft 54 through a gear, and a first connecting shaft 58 connected to the countershaft 56 through several gears. Those shafts 54, 56, 58 are installed in parallel.

The countershaft 56 is connected with a hydraulic pump (gear pump; shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that the transmission 46 is selectively changeable in the gear position to establish one of the three speeds (i.e., first to third speeds), and the output of the engine 30 is changed with the gear ratio determined by the established (selected) gear position (speed; gear) and transmitted to the propeller 42 through the shift mechanism 52 and propeller shaft 44. A gear ratio of the gear position (speed) is set to be the highest in the first speed and decreases as the speed changes to second and then third speed.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also supported with a counter first-speed gear 68, counter second-speed gear 70 and counter third-speed gear 72.

The first connecting shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the first connecting shaft 58 is brought into a connection with the first connecting shaft 58 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear position) is established and the rotational speed of the first connecting shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch (transmission clutch) C2, the second speed (gear position) is established. Further, when the counter third-speed gear 72 supported to be rotatable relative to the countershaft 56 is brought into a connection with the countershaft 56 through the third-speed hydraulic clutch (transmission clutch) C3, the third speed (gear position) is established. The hydraulic clutches C2, C3 connect the gears 70, 72 to the countershaft 56 upon being supplied with the hydraulic pressure, while making the gears 70, 72 rotate idly when the hydraulic pressure is not supplied.

The interconnections between the gears and shafts through the clutches C1, C2, C3 are performed by controlling hydraulic pressure supplied from the pump 60 to the hydraulic clutches C2, C3.

The further explanation will be made. When the oil pump 60 is driven by the engine 30, it pumps up the operating oil in the oil pan 62*a* to be drawn through an oil passage 80*a* and strainer 82 and forwards it from a discharge port 60*a* to a first switching valve 84*a* through an oil passage 80*b* and to first and second electromagnetic solenoid valves (linear solenoid valves) 86*a*, 86*b* through oil passages 80*c*, 80*d*.

The first switching valve 84*a* is connected to a second switching valve 84*b* through an oil passage 80*e*. Each of the valves 84*a*, 84*b* has a movable spool installed therein and the spool is urged by a spring at its one end (left end in the drawing) toward the other end. The valves 84*a*, 84*b* are connected on the sides of the other ends of the spools with the first and second solenoid valves 86*a*, 86*b* through oil passages 80*f*, 80*g*, respectively.

Upon being supplied with current (i.e., made ON), a spool housed in the first solenoid valve 86*a* is displaced to output the hydraulic pressure supplied from the pump 60 through the oil passage 80*c* to the other end side of the spool of the first switching valve 84*a*. Accordingly, the spool of the first switching valve 84*a* is displaced to its one end side, thereby forwarding the operating oil in the oil passage 80*b* to the oil passage 80*e*.

Similarly to the first solenoid valve 86*a*, upon being supplied with current (i.e., made ON), a spool of the second solenoid valve 86*b* is displaced to output the hydraulic pressure supplied from the pump 60 through the oil passage 80*d* to the other end side of the spool of the second switching valve 84*b*. Accordingly, the spool of the second switching valve 84*b* is displaced to its one end side, thereby forwarding the operating oil in the oil passage 80*e* to the second-speed hydraulic clutch C2 through the oil passage 80*h*. In contrast, when the second solenoid valve 86*b* is not supplied with current (made OFF) and no hydraulic pressure is outputted to the other end side of the second switching valve 84*b*, the operating oil in the oil passage 80*e* is forwarded to the third-speed hydraulic clutch C3 through the oil passage 80*i*.

When the first and second solenoid valves 86*a*, 86*b* are both made OFF, the hydraulic pressure is not supplied to the hydraulic clutches C2, C3 and hence, the output first-speed gear 74 and first connecting shaft 58 are interconnected through the first-speed clutch C1 so that the first speed is established.

When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established.

Thus, one of the gear positions of the transmission 46 is selected (i.e., transmission control is conducted) by controlling ON/OFF of the first and second switching valves 84*a*, 84*b*.

Note that the operating oil (lubricating oil) from the hydraulic pump 60 is also supplied to the lubricated portions (e.g., the shafts 54, 56, 58, etc.) of the transmission 46 through the oil passage 80*b*, an oil passage 80*j*, a regulator valve 88 and a relief valve 90. Also, the first and second switching valves 84*a*, 84*b* and the first and second solenoid valves 86*a*, 86*b* are connected with an oil passage 80*k* adapted to relieve pressure.

The explanation on FIG. 2 is resumed. The shift mechanism 52 comprises a second connecting shaft 52*a* that is connected to the first connecting shaft 58 of the transmission mechanism 50 and installed parallel to the vertical axis to be rotatably supported, a forward bevel gear 52*b* and reverse bevel gear 52*c* that are connected to the second connecting shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among forward, reverse and neutral positions.

When the shift position is the forward or reverse position, the rotational output of the first connecting shaft 58 is transmitted via the shift mechanism 52 to the propeller shaft 44 to rotate the propeller 42 to generate the thrust in one of the directions making the boat 1 move forward or backward. The outboard motor 10 is equipped with a power source (not shown) such as a battery or the like attached to the engine 30 to supply operating power to the motors 22, 40, 92, etc.

As shown in FIG. 3, a throttle opening sensor (throttle opening change amount detector) 96 is installed near the throttle valve 38 and produces an output or signal indicative of opening of the throttle valve 38, i.e., throttle opening TH. A neutral switch 100 is installed near the shift rod 52*e* and produces an ON signal when the shift position of the transmission 46 is neutral and an OFF signal when it is forward or reverse. A crank angle sensor (engine speed detector) 102 is installed near the crankshaft of the engine 30 and produces a pulse signal at every predetermined crank angle.

A trim angle sensor 104 is installed near the tilting shaft 16 and produces an output or signal corresponding to a trim angle θ of the outboard motor 10 (i.e., a rotation angle of the outboard motor 10 about its pitching axis relative to the hull 12). A rudder angle sensor (rudder angle detector) 106 installed near the shaft 20 produces an output or signal corresponding to a rotation angle of the shaft 22, i.e., the rudder angle α of the outboard motor 10 relative to the hull 12.

The rudder angle sensor 106 outputs a signal indicating 0 degree when the outboard motor 10 is positioned (at an angle) relative to the hull 12 to make the boat 1 travel straight. When the outboard motor 10 is rotated in a clockwise direction, the rudder angle sensor 106 outputs a positive value corresponding to the rotation angle, while, when it is rotated in a counterclockwise direction, the sensor 106 outputs a negative value. The sensors 104 and 106 comprise rotation angle sensors such as rotary encoders.

The outputs of the foregoing sensors and switch are sent to an Electronic Control Unit (ECU) 110 disposed in the outboard motor 10. The ECU 110 comprises a microcomputer having a CPU, ROM, RAM and other devices and is installed in the engine cover 32 of the outboard motor 10.

As shown in FIG. 1, a steering wheel 114 is installed near a cockpit (the operator's seat) 112 of the hull 12 to be manipulated by the operator (not shown). The steering wheel 114 is rotated to rightward and leftward from the initial position (position to make the boat 1 travel straight) through the manipulation. A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever (throttle lever) 122 installed to be manipulated by the operator. The lever 122 can be moved or swung in the front-back direction from the initial position and is used by the operator to input a forward/reverse change command and an engine speed regulation command including an acceleration/deceleration command or instruction for the engine 30. A lever position sensor 124 is installed in the remote control box 120 and produces an output or signal corresponding to a position of the lever 122.

Figure 5:
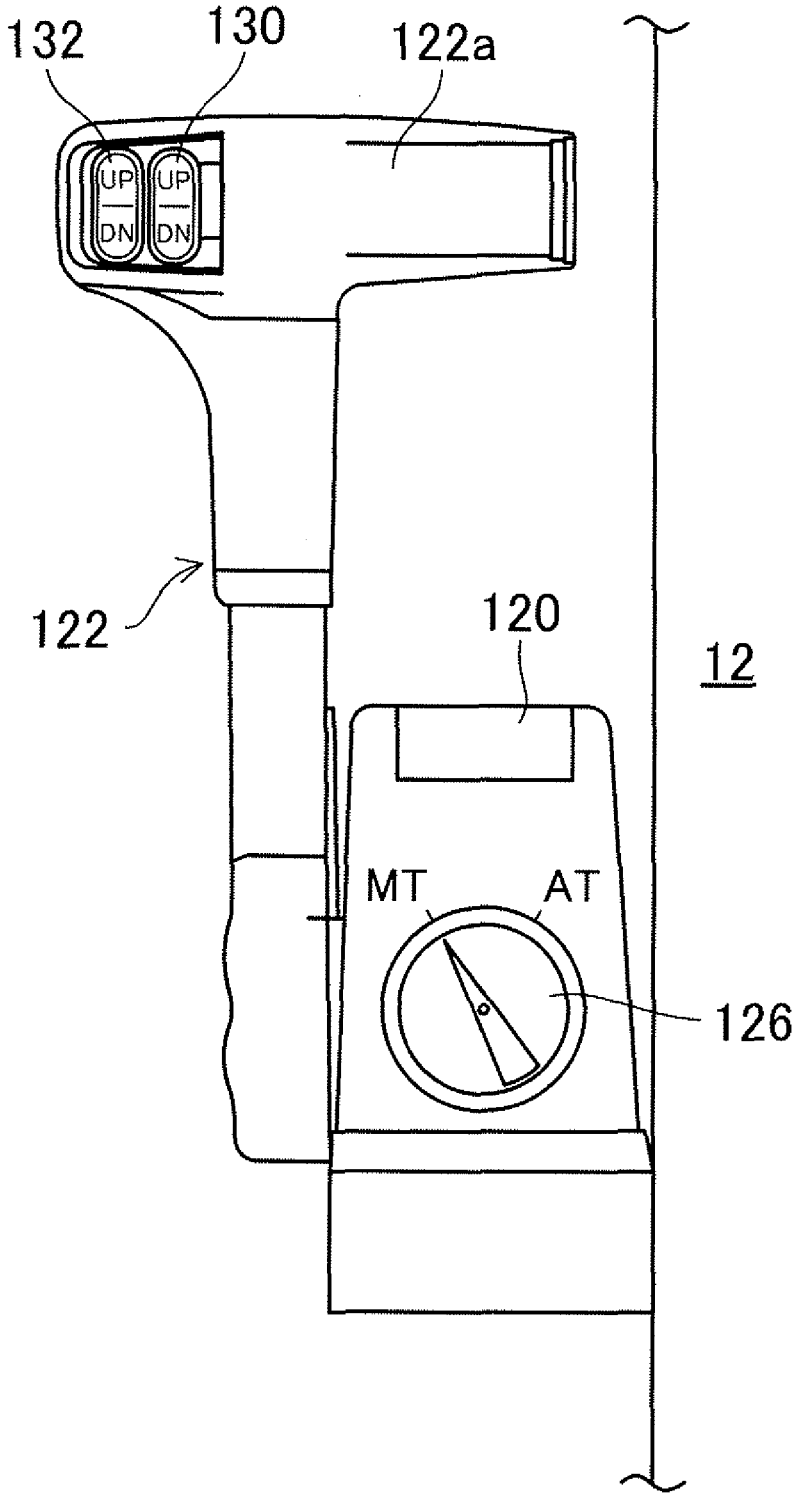
FIG. 5 is an enlarged side view of a remote control box and shift/throttle lever shown in FIG. 1 when viewed from the rear of the boat.

FIG. 5 is an enlarged side view of the remote control box 120 and lever 122 shown in FIG. 1 when viewed from the rear of the boat 1.

As shown in FIG. 5, a change switch 126 is installed in the remote control box 120 to be manipulated by the operator. The change switch 126 is manipulated to select one of a manual speed change mode ("MT" in FIG. 5) and automatic speed change mode ("AT") and produces an output or signal indicative of a selected mode. When the manual speed change mode is selected, transmission control of the transmission 46 is conducted in response to a speed change command inputted by the operator and when the automatic speed change mode is selected, the transmission control is conducted based on the engine speed NE, throttle opening TH, etc., which will be explained later.

The lever 122 is equipped with a grip 122*a* to be gripped or held by the operator and the grip 122*a* is provided with a power tilt-trim switch (trim angle regulation command outputter; hereinafter called the "trim switch") 130 and shift switch 132. The switches 130, 132 are installed to be manipulated by the operator.

The trim switch 130 comprises pushing type switches including an up switch ("UP" in FIG. 5) and a down switch ("DN"). When the up switch is pressed by the operator, the trim switch 130 produces an output or signal (ON signal) indicative of a command to regulate the trim angle by trimming up the outboard motor 10, while when the down switch is pressed, producing an output or signal (ON signal) indicative of a command to regulate the trim angle by trimming down the outboard motor 10. Thus the trim switch 130 outputs a trim angle regulation command in response to the manipulation by the operator.

Similarly, the shift switch 132 comprises pushing type switches including an up switch ("UP" in FIG. 5) and a down switch ("DN") and produces an output or signal indicative of a shift-up command (speed change command) upon pressing of the up switch, while producing that indicative of a shift-down command (speed change command) upon pressing of the down switch.

An acceleration sensor 134 for detecting acceleration acting on the hull 12 is disposed near the cockpit 112 and in the center of gravity of the hull 12. The acceleration sensor 134 produces an output or signal indicative of acceleration acting on the hull 12 in its vertical (gravitational) direction, etc.

A switch 136 is also provided near the cockpit 112 to be manually operated by the operator to input a fuel consumption decreasing command for decreasing fuel consumption of the engine 30. The switch 136 is manipulated or pressed when the operator desires to travel the boat 1 with high fuel efficiency, and upon the manipulation, it produces a signal (ON signal) indicative of the fuel consumption decreasing command. The outputs of the sensors and switches are also sent to the ECU 110.

Based on the inputted outputs, the ECU 110 controls the operation of the motors 22, 40, 92, while performing the transmission control of the transmission 46 and the trim angle control for regulating the trim angle θ through the trim unit 24. Thus, the outboard motor control apparatus according to the embodiments is a Drive-By-Wire type apparatus whose operation system (steering wheel 114, lever 122) has no mechanical connection with the outboard motor 10.

Figure 6:
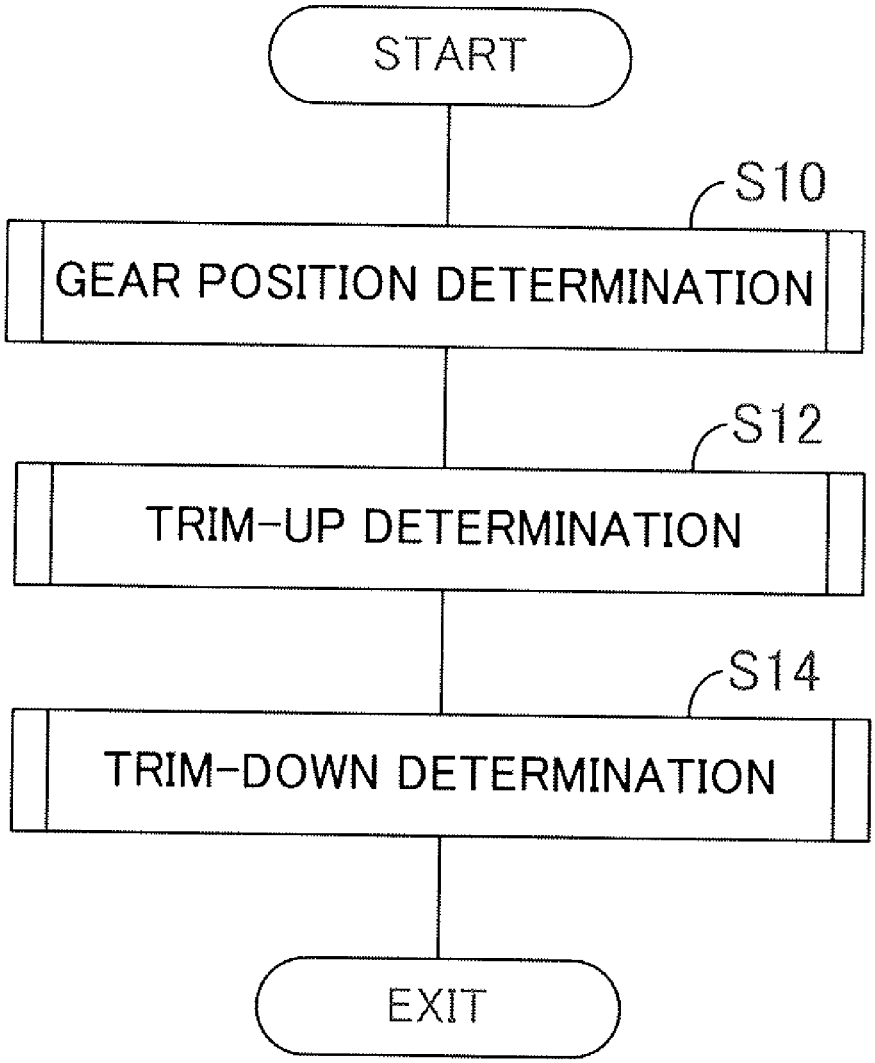
FIG. 6 is a flowchart showing transmission control operation and trim angle control operation by an electronic control unit shown in FIG. 1.

FIG. 6 is a flowchart showing the transmission control operation and trim angle control operation by the ECU 110. The illustrated program is executed by the ECU 110 at predetermined intervals, e.g., 100 milliseconds. Note that the change switch 126 is positioned in the automatic speed change mode here.

The program begins at S10, in which the operation for determining which one from among the first to third speeds of the transmission 46 should be selected, is conducted.

Figure 7:
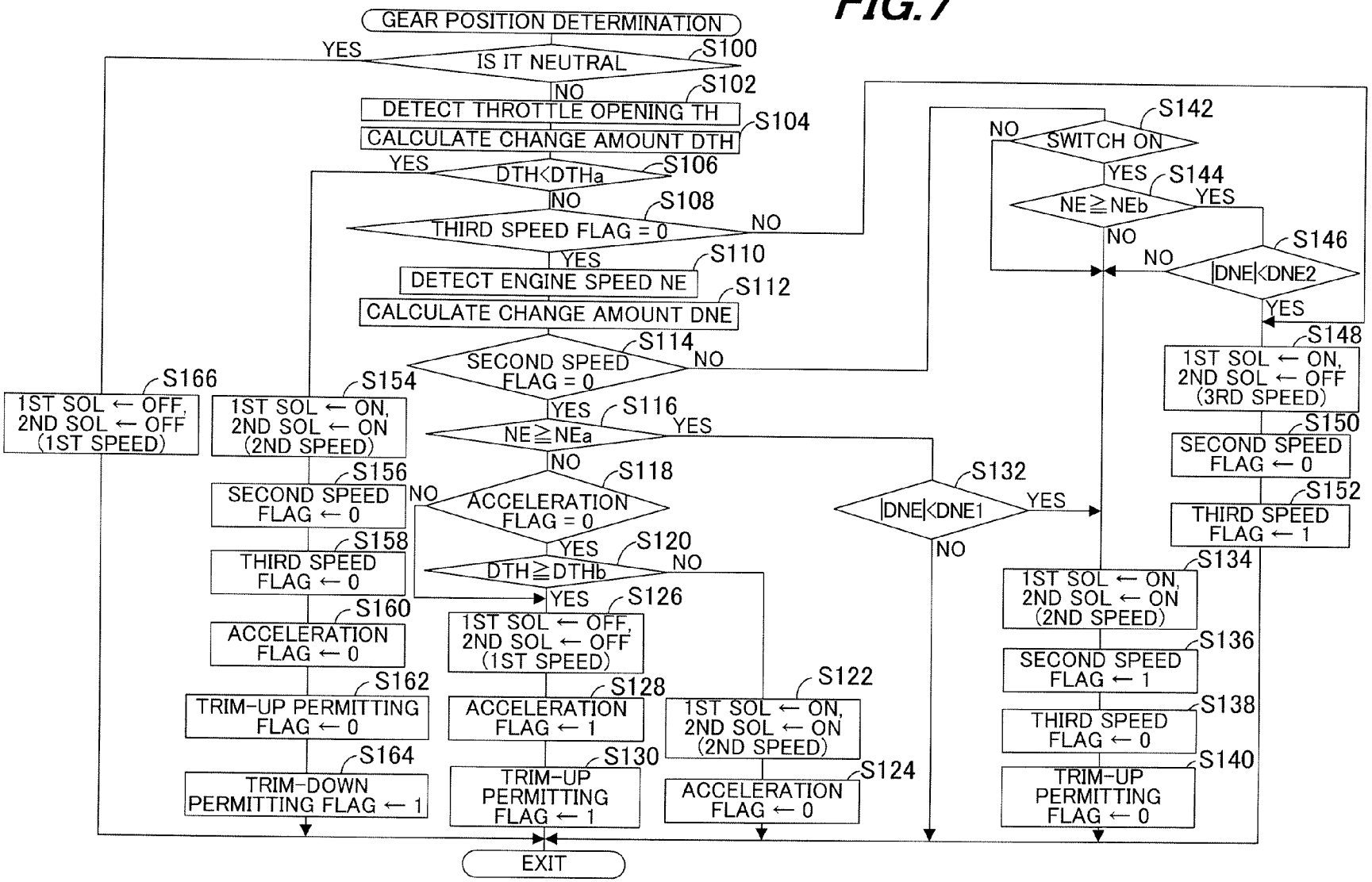
FIG. 7 is a subroutine flowchart showing the operation of gear position determination in the FIG. 6 flowchart.

FIG. 7 is a subroutine flowchart showing the operation of the gear position determination. First, in S100, it is determined whether the shift position of the transmission 46 is at the neutral position. This determination is made by checking as to whether the neutral switch 100 outputs the ON signal. When the result in S100 is negative, i.e., it is determined to be in gear, the program proceeds to S102, in which the throttle opening TH is detected or calculated from the output of the throttle opening sensor 96, and to S104, in which a change amount (variation) DTH of the detected throttle opening TH per unit time (e.g., 500 milliseconds) is detected or calculated.

The program proceeds to S106, in which it is determined whether the deceleration is instructed to the engine 30 by the operator, i.e., whether the engine 30 is in the operating condition to decelerate the boat 1. This determination is made by checking as to whether the throttle valve 38 is operated in the closing direction. More specifically, when the change amount DTH is less than a deceleration-determining predetermined value (second predetermined value) DTHa (e.g., −0.5 degree) set to a negative value, the throttle valve 38 is determined to be operated in the closing direction (i.e., the deceleration is instructed to the engine 30).

When the result in S106 is negative, the program proceeds to S108, in which it is determined whether the bit of an after-acceleration third-speed changed flag (explained later; hereinafter called the "third speed flag") which indicates that the gear position has been changed to the third speed after the acceleration was completed, is 0. Since the initial value of this flag is 0, the result in S108 in the first program loop is generally affirmative and the program proceeds to S110.

The program proceeds to S110, in which the engine speed NE is detected or calculated by counting the output pulses from the crank angle sensor 102 and to S112, in which a change amount (variation) DNE of the engine speed NE is calculated. The change amount DNE is obtained by subtracting the engine speed NE detected in the present program loop from that detected in the previous program loop.

Next, the program proceeds to S114, in which it is determined whether the bit of an after-acceleration second-speed changed flag (hereinafter called the "second speed flag") is 0. The bit of this flag is set to 1 when the gear position is changed from the first speed to the second speed after the acceleration is completed, and otherwise, reset to 0.

Since the initial value of the second speed flag is also 0, the result in S114 in the first program loop is generally affirmative and the program proceeds to S116, in which it is determined whether the engine speed NE is equal to or greater than a second-speed change predetermined speed (second predetermined speed) NEa. The predetermined speed NEa will be explained later.

Since the engine speed NE is generally less than the predetermined speed NEa in a program loop immediately after the engine start, the result in S116 is negative and the program proceeds to S118, in which it is determined whether the bit of an acceleration determining flag (explained later; indicated by "acceleration flag" in the drawing) is 0. Since the initial value of this flag is also 0, the result in S118 in the first program loop is generally affirmative and the program proceeds to S120.

In S120, it is determined whether the acceleration (precisely, the rapid acceleration) is instructed to the engine 30 by the operator, i.e., whether the engine 30 is in the operating condition to (rapidly) accelerate the boat 1. This determination is made by checking as to whether the throttle valve 38 is operated in the opening direction rapidly.

Specifically, the change amount DTH of the throttle opening TH detected in S104 is compared with an acceleration-determining predetermined value (predetermined value) DTHb and when the change amount DTH is equal to or greater than the predetermined value DTHb, it is determined that the throttle valve 38 is operated in the opening direction rapidly, i.e., the acceleration is instructed to the engine 30. The predetermined value DTHb is set to a value (positive value, e.g., 0.5 degree) greater than the deceleration-determining predetermined value DTHa, as a criterion for determining whether the acceleration is instructed to the engine 30.

When the result in S120 is negative, i.e., it is determined that neither the acceleration nor the deceleration is instructed to the engine 30, the program proceeds to S122, in which the first and second solenoid valves 86*a*, 86*b* (indicated by "1ST SOL," "2ND SOL" in the drawing) are both made ON to select the second speed in the transmission 46, and to S124, in which the bit of the acceleration determining flag is reset to 0.

On the other hand, when the result in S120 is affirmative, the program proceeds to S126, in which the first and second solenoid valves 86*a*, 86*b* are both made OFF to change the gear position (shift down the gear) of the transmission 46 from the second speed to the first speed. As a result, the output torque of the engine 30 is amplified through the transmission 46 (more precisely, the transmission mechanism 50) which has been shifted down to the first speed, and transmitted to the propeller 42 via the propeller shaft 44, thereby improving the acceleration performance.

Then the program proceeds to S128, in which the bit of the acceleration determining flag is set to 1. Specifically, the bit of this flag is set to 1 when the change amount DTH of the throttle opening TH is equal to or greater than the acceleration-determining predetermined value DTHb and the transmission 46 is changed from the second speed to the first speed, and otherwise, reset to 0. Upon setting of the bit of the acceleration determining flag to 1, the result in S118 in the next and subsequent loops becomes negative and the program skips S120.

Thus, since the transmission 46 is set in the second speed during a period from when the engine 30 is started until the acceleration is instructed (i.e., during the normal operation), it becomes possible to ensure the usability of the outboard motor 10 similarly to that of an outboard motor having no transmission.

Next, the program proceeds to S130, in which the bit of a trim-up permitting flag (initial value 0) is set to 1, whereafter the program is terminated. Specifically, the bit of this flag being set to 1 means that the change amount DTH is equal to or greater than the predetermined value DTHb and the transmission 46 is changed to the first speed, in other words, the trim-up operation to be conducted based on the engine speed NE is permitted (explained later), while that being reset to 0 means that the trim-up operation is not needed, i.e., for example, the deceleration is instructed to the engine 30.

After the transmission 46 is changed to the first speed, when the engine speed NE is gradually increased and the acceleration through the torque amplification in the first speed is completed (i.e., the acceleration range is saturated), the engine speed NE reaches the predetermined speed NEa. Consequently, in the following program loop, the result in S116 becomes affirmative and the program proceeds to S132 onward. The predetermined speed NEa is set to a relatively high value (e.g., 6000 rpm) as a criterion for determining whether the acceleration in the first speed is completed.

In S132, it is determined whether the engine speed NE is stable, i.e., the engine 30 is stably operated. This determination is made by comparing an absolute value of the change amount DNE of the engine speed NE with a first prescribed value (prescribed value) DNE1. When the absolute value is less than the first prescribed value DNE1, the engine speed NE is determined to be stable. The first prescribed value DNE1 is set as a criterion (e.g., 500 rpm) for determining whether the engine speed NE is stable, i.e., the change amount DNE is relatively small.

When the result in S132 is negative, the program is terminated with the first speed being maintained, and when the result is affirmative, the program proceeds to S134, in which the first and second solenoid valves 86*a*, 86*b* are both made ON to change the transmission 46 (shift up the gear) from the first speed to the second speed. It causes the increase in the rotational speed of the shaft 52*a* and that of the propeller shaft 44, so that the boat speed reaches the maximum speed (in a range of the engine performance), thereby improving the speed performance.

Then the program proceeds to S136, in which the bit of the second speed flag is set to 1, to S138, in which the bit of the third speed flag is reset to 0 and to S140, in which the bit of the trim-up permitting flag is reset to 0. As a result, the trim-up operation of the outboard motor 10 is stopped in another program (explained later) at the same time (synchronously) when the gear position is changed from the first speed to the second speed.

When the bit of the second speed flag is set to 1 in S136, the result in S114 in the next and subsequent program loops becomes negative and the program proceeds to S142. Thus the process of S142 onward is conducted when the bit of the second speed flag is set to 1, i.e., the gear position is changed to the second speed after the acceleration in the first speed is completed.

In S142, it is determined whether the switch 130 outputs the ON signal, i.e., whether the fuel consumption decreasing command for the engine 30 is inputted by the operator. When the result in S142 is negative, the program proceeds to S134 to S140 mentioned above, while when the result is affirmative, proceeding to S144, in which it is determined whether the engine speed NE is equal to or greater than a third-speed change predetermined speed NEb. The predetermined speed NEb is set to a value (e.g., 5000 rpm) slightly lower than the second-speed change predetermined speed NEa, as a criterion for determining whether it is possible to change the gear position to the third speed (explained later).

When the result in S144 is affirmative, the program proceeds to S146, in which, similarly to S132, it is determined whether the engine speed NE is stable. Specifically, the absolute value of the change amount DNE of the engine speed NE is compared with a second prescribed value DNE2 and when it is less than the second prescribed value DNE2, the engine speed NE is determined to be stable. The second prescribed value DNE2 is set as a criterion (e.g., 500 rpm) for determining whether the change amount DNE is relatively small and the engine speed NE is stable.

When the result in S146 or S144 is negative, the program proceeds to S134 and when the result in S146 is affirmative, the program proceeds to S148, in which the first solenoid valve 86*a* is made ON and the second solenoid valve 86*b* is made OFF to change the transmission 46 (shift up the gear) from the second speed to the third speed. As a result, the engine speed NE is decreased, thereby decreasing the fuel consumption, i.e., improving the fuel efficiency.

Next, the program proceeds to S150, in which the bit of the second speed flag is reset to 0 and to S152, in which the bit of the third speed flag is set to 1. Thus, the third speed flag is set to 1 when the gear position is changed from the second speed to the third speed after the acceleration is completed, and otherwise, reset to 0. Note that, in a program loop after the bit of the third speed flag is set to 1, the result in S108 is negative and the process of S148 to S152 is conducted, whereafter the program is terminated with the third speed being maintained.

When the result in S106 is affirmative, i.e., when the change amount DTH is less than the predetermined value DTHa, the program proceeds to S154, in which the first and second solenoid valves 86*a*, 86*b* are both made ON to change the gear position to the second speed. Then the program proceeds to S156, S158 and S160, in which the bits of the second speed flag, third speed flag and acceleration determining flag are all reset to 0.

Then the program proceeds to S162, in which the bit of the trim-up permitting flag is reset to 0 and to S164, in which the bit of a trim-down permitting flag (initial value 0) is set to 1. The bit of the trim-down permitting flag being set to 1 means that the change amount DTH is less than the predetermined value DTHa and the trim-down operation (explained later) is permitted, while that being reset to 0 means that the trim-down operation is not needed.

When the lever 122 is manipulated by the operator to change the shift position of the transmission 46 to neutral, the result in S100 is affirmative and the program proceeds to S166, in which the first and second solenoid valves 86*a*, 86*b* are both made OFF to change the transmission 46 from the second speed to the first speed.

Returning to the explanation on the FIG. 6 flowchart, the program proceeds to S12, in which it is determined whether the trim-up operation of the outboard motor 10 should be conducted.

Figure 8:
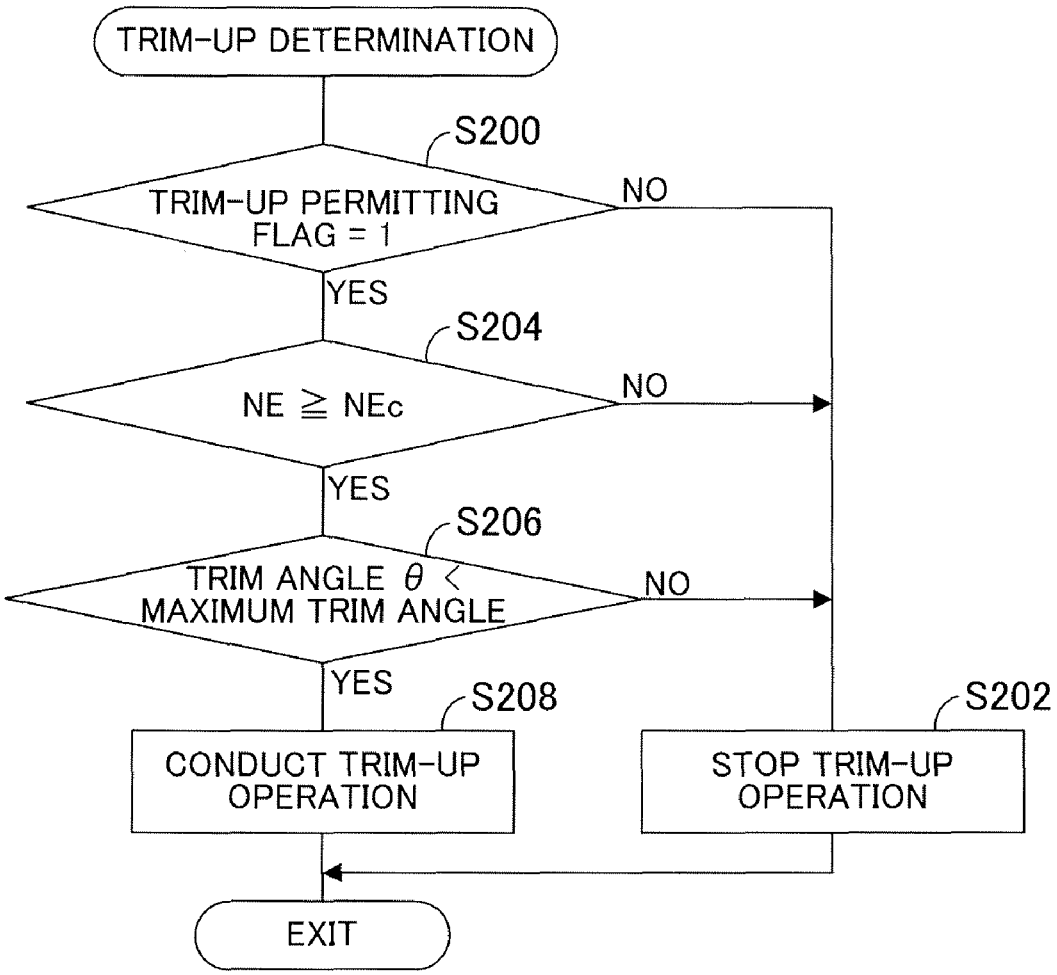
FIG. 8 is a subroutine flowchart showing the operation of trim-up determination in the FIG. 6 flowchart.

FIG. 8 is a subroutine flowchart showing the operation of the trim-up determination. As shown in FIG. 8, in S200, it is determined whether the bit of the trim-up permitting flag is 1. When the result in S200 is negative, since it means that the trim-up operation is not needed, the program proceeds to S202, in which the trim-up operation is stopped, more precisely, not conducted. When the result in S200 is affirmative, i.e., when the change amount DTH is equal to or greater than the predetermined value DTHb and the transmission 46 is changed to the first speed, the program proceeds to S204, in which it is determined based on the engine speed NE whether it is immediately before the acceleration in the first speed is completed and the transmission 46 is changed back from the first speed to the second speed.

Specifically, the engine speed NE is compared to a trim-up predetermined speed (first predetermined speed) NEc. When the engine speed NE is equal to or greater than the predetermined speed NEc, it is determined to be immediately before the acceleration in the first speed is completed and the gear position is changed back from the first speed to the second speed. The predetermined speed NEc is set as a criterion (e.g., 5000 rpm) for determining whether it is immediately before the acceleration is completed, more precisely, set lower than the second-speed change predetermined speed NEa which is the threshold value used when the gear position is changed back from the first speed to the second speed. In other words, the predetermined speed NEa is set greater than the predetermined speed NEc.

When the result in S204 is negative, since it is not the time to start the trim-up operation, the program proceeds to S202 and the program is terminated without conducting the trim-up operation. When the result in S204 is affirmative, the program proceeds to S206, in which it is determined whether the trim angle θ is less than the maximum trim angle (the maximum value in the possible trim angle range which can be reached through the trim-up operation by the trim unit 24, e.g., 10 degrees).

When the result in S206 is negative, since it is impossible to further trim up the outboard motor 10, the program proceeds to S202, in which the trim-up operation is stopped or not conducted. On the other hand, when the result in S206 is affirmative, the program proceeds to S208, in which the trim unit 24 is operated to start and conduct the trim-up operation. Thus, the trim-up operation is started before the acceleration is completed and the transmission 46 is changed back from the first speed to the second speed, thereby increasing the boat speed.

In the next program loop, when the result in S200 is negative, i.e., when the gear position is changed from the first speed to the second speed in S134 and the bit of the trim-up permitting flag is reset to 0 in S140, the program proceeds to S202, in which the trim-up operation is stopped or not conducted.

Returning to the explanation on the FIG. 6 flowchart, the program proceeds to S14, in which it is determined whether the trim-down operation of the outboard motor 10 should be conducted.

Figure 9:
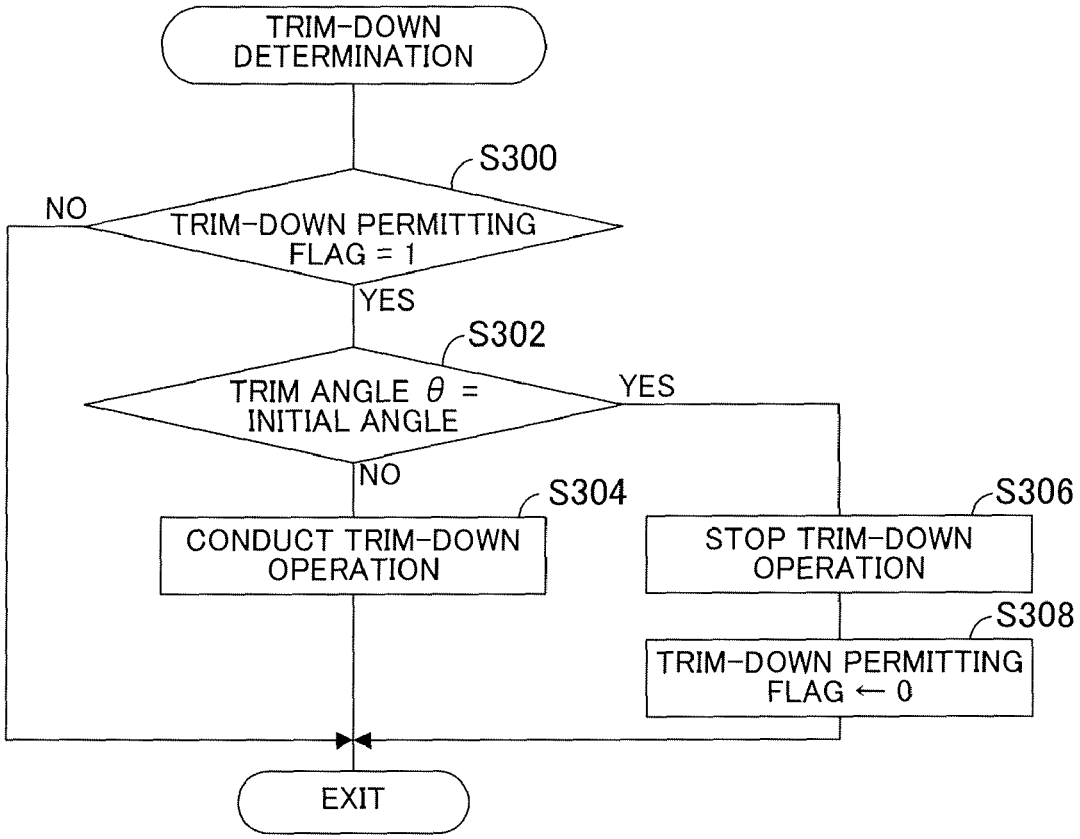
FIG. 9 is a subroutine flowchart showing the operation of trim-down determination in FIG. 6 flowchart.

FIG. 9 is a subroutine flowchart showing the operation of the trim-down determination. As shown in FIG. 9, in S300, it is determined whether the bit of the trim-down permitting flag is 1. When the result is negative, the remaining steps are skipped and when the result is affirmative, i.e., when the change amount DTH of the throttle opening TH is less than the deceleration-determining predetermined value DTHa, the program proceeds to S302, in which it is determined whether the trim angle θ is at the initial angle (i.e., 0 degree).

When the result in S302 is negative, the program proceeds to S304, in which the trim unit 24 is operated to start the trim-down operation. After that, when the trim angle θ has been returned to the initial angle, the result in S302 is affirmative and the program proceeds to S306, in which the trim-down operation is stopped and to S308, in which the bit of the trim-down permitting flag is reset to 0, whereafter the program is terminated.

Figure 10:
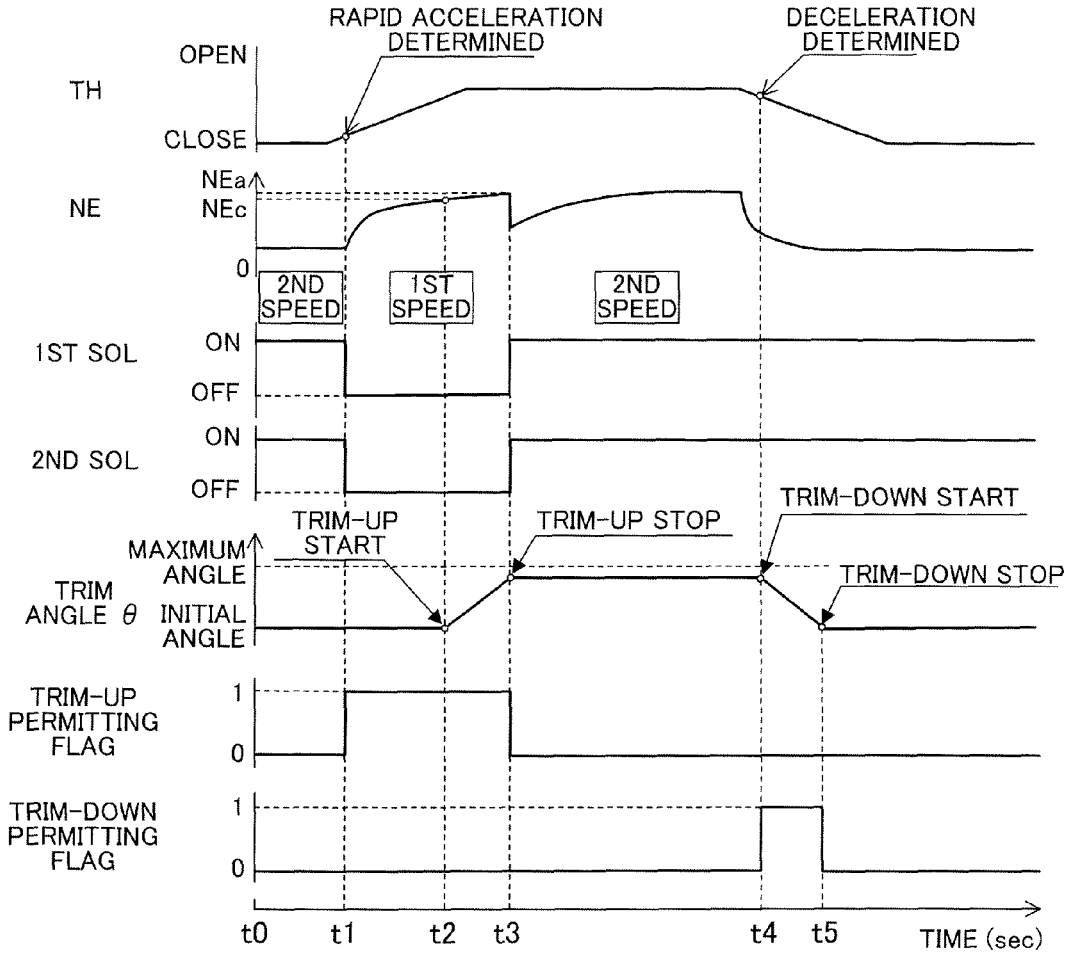
FIG. 10 is a time chart for explaining the operation of the flowcharts in FIGS. 6 to 8.

FIG. 10 is a time chart for partially explaining the operation of the foregoing operation and FIGS. 11A to 11E are explanatory views thereof. In FIG. 11, a symbol y indicates the front-back direction of the outboard motor 10, a symbol z the vertical direction thereof, a symbol W seawater or freshwater, and a symbol S the water surface. The front-back direction y and vertical direction z represent those with respect to the outboard motor 10 and they may differ from the gravitational direction and horizontal direction depending on the tilt angle or trim angle of the outboard motor 10.

As shown in FIG. 10, in the normal operation from the time t0 to t1, the transmission 46 is set in the second speed (S122). Then, when the throttle valve 38 is opened upon the manipulation of the lever 122 by the operator and, at the time t1, the change amount DTH is equal to or greater than the predetermined value DTHb (S120), the gear position is changed from the second speed to the first speed (S126). At this time, the bit of the trim-up permitting flag is set to 1 (S130).

Figure 11A:
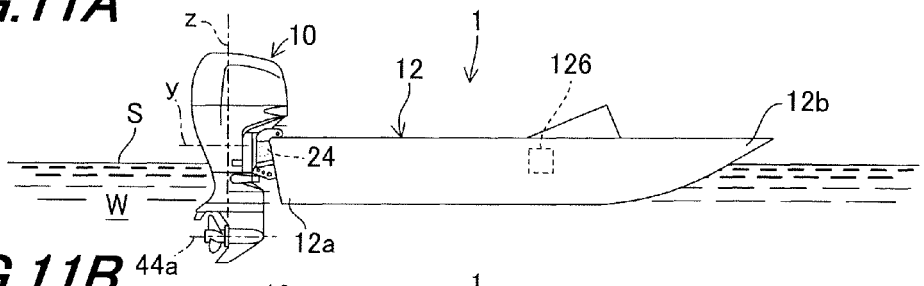
FIG. 11 are explanatory views for explaining the operation of the flowcharts in FIGS. 6 to 8.
Figure 11B:
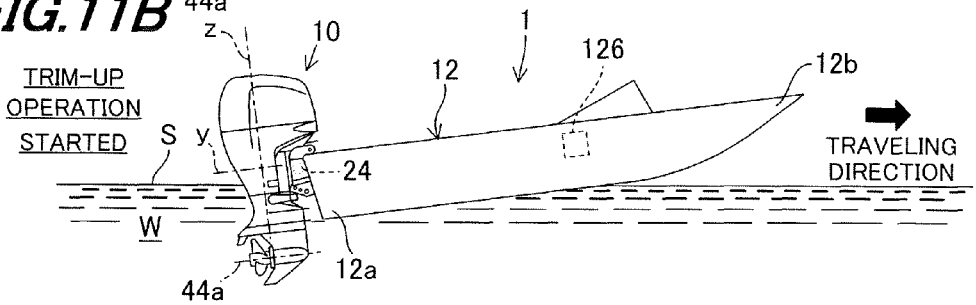

As shown in FIG. 11A, at the time t0 to t1, the hull 12 and outboard motor 10 are both in the horizontal position and the trim angle θ is at the initial angle (0 degree). When the gear position is changed to the first speed upon the acceleration at the time t1 and the boat speed is increased, as shown in FIG. 11B, the bow 12*b* of the hull 12 is lifted up and the stern 12*a* thereof is sunk down (the boat speed lies the so-called "hump" region). As can be seen from the drawing, the axis line 44*a* of the propeller shaft 44 is not parallel with the traveling direction of the boat 1.

When the acceleration is continued so that the engine speed NE is gradually increased and reaches the predetermined speed NEc or more at the time t2, the trim-up operation of the outboard motor 10 is started (S204, S208). Subsequently, when the engine speed NE is further increased and becomes equal to or greater than the predetermined speed NEa (S116; time t3), the gear position is changed from the first speed to the second speed (S134). Further, the trim-up operation is stopped synchronously with this change in the gear position (S140, S200, S202).

Figure 11C:
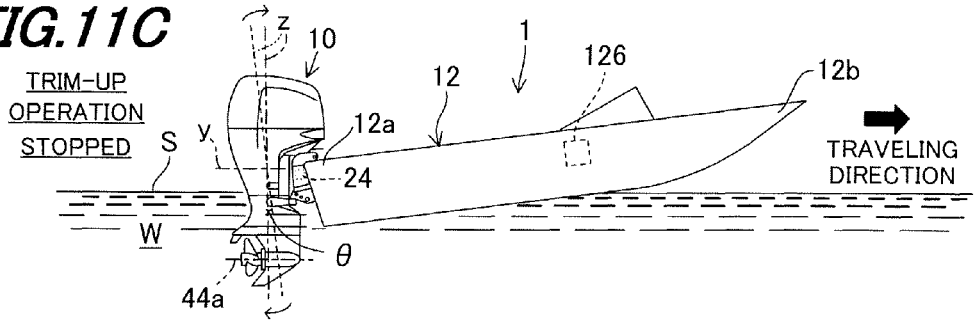

The condition where the trim-up operation is stopped is shown in FIG. 11C. As clearly shown, since the outboard motor 10 is trimmed up to regulate the trim angle θ, the axis line 44*a* of the propeller shaft 44 (i.e., the direction of thrust of the outboard motor 10) can be positioned substantially parallel with the traveling direction of the boat 1. As a result, the resistance against the hull 12 from the water surface S can be reduced, while the thrust of the hull 12 can be increased, thereby increasing the boat speed.

Figure 11D:
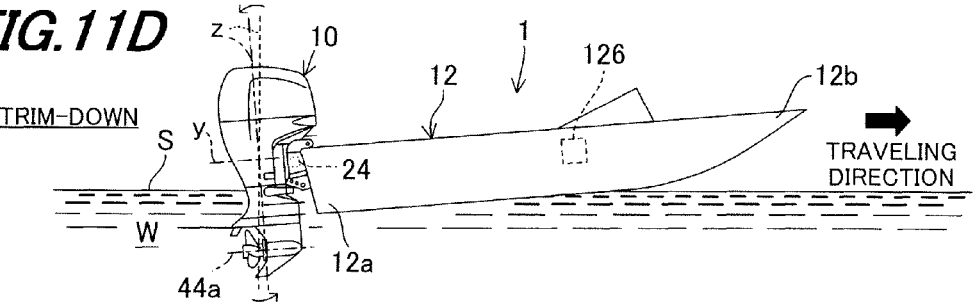

After that, when, at the time t4, the lever 122 is manipulated by the operator and the change amount DTH is less than the predetermined value DTHa, the bit of the trim-down permitting flag is set to 1 (S106, S164) and the trim-down operation of the outboard motor 10 is started (S300 to S304). Then, at the time t5, when the trim angle θ is regulated back to the initial angle, the trim-down operation is stopped and the bit of the trim-down permitting flag is reset to 0 (S302, S306, S308). The condition where the trim angle θ is returned to the initial angle is shown in FIG. 11D.

As mentioned above, in the apparatus and method according to the first embodiment, there are provided with a throttle opening change amount detector (throttle opening sensor 96, ECU 110, S10, S104) adapted to detect a change amount DTH of throttle opening TH of the engine 30; an engine speed detector (crank angle sensor 102, ECU 110, S10, S110) adapted to detect speed of the engine (engine speed NE); a first-speed changer (ECU 110, S10, S120, S126) adapted to change the gear position of the transmission 46 from the second speed to the first speed when the gear position is in the second speed and the detected change amount DTH of the throttle opening is equal to or greater than a predetermined value (acceleration-determining predetermined value) DTHb; a trim-up starter (ECU 110, S10, S12, S130, S200, S204, S208) adapted to start the trim-up operation through the trim angle regulation mechanism 24 when the detected engine speed NE is equal to or greater than a first predetermined speed (trim-up predetermined speed) NEc after the gear position is changed to the first speed by the first-speed changer; a second-speed changer (ECU 110, S10, S116, S134) adapted to change the gear position from the first speed to the second speed when the detected engine speed NE is equal to or greater than a second predetermined speed (second-speed change predetermined speed) NEa set greater than the first predetermined speed NEc after the trim-up operation is started by the trim-up starter; and a trim-up stopper (ECU 110, S10, S12, S140, S200, S202) adapted to stop the trim-up operation after the gear position is changed to the second speed by the second-speed changer.

Thus, when the second speed is selected and the change amount DTH is equal to or greater than the predetermined value DTHb (when the acceleration is instructed to the engine 30), the transmission 46 is operated to change the second speed to the first speed and when the engine speed NE becomes equal to or greater than the first predetermined speed NEc, the trim unit 24 is operated to start the trim-up operation. After that, when the engine speed NE becomes equal to or greater than the second predetermined speed NEa set greater than the first predetermined speed NEc, the transmission 46 is changed from the first speed to the second speed. With this, it becomes possible to trim up the outboard motor 10 before the transmission 46 is changed from the first speed to the second speed, thereby increasing the boat speed. Therefore, even when the gear position is changed from the first speed to the second speed after the acceleration is completed and the torque to be transmitted to the propeller 42 is decreased, since the boat speed is still increased through the trim-up operation, it becomes possible to avoid giving a deceleration feel to the operator, i.e., mitigate the deceleration feel.

Further, since the trim-up operation is stopped after the transmission 46 is changed from the first speed to the second speed, the trim-up operation can be stopped at the right time regardless of size of the hull 12 and accordingly, it becomes possible to prevent the pitching which may occur due to excessive trim-up operation.

The apparatus further includes an engine speed change amount calculator (ECU 110, S10, S112) adapted to calculate a change amount DNE of the detected engine speed NE, and the second-speed changer changes the gear position from the first speed to the second speed when the detected engine speed NE is equal to or greater than the second predetermined speed NEa and the calculated change amount DNE of the engine speed is less than a prescribed value (S10, S116, S132, S134). With this, in addition to the above effects, it becomes possible to change the gear position to the second speed immediately after the acceleration through the torque amplification in the first speed is completed, thereby shortening a time period after the acceleration is completed until the boat speed reaches the maximum speed.

The apparatus further includes a trim-down starter (ECU 110, S10, S14, S106, S164, S300, S304) adapted to start the trim-down operation through the trim angle regulation mechanism 24 when the detected change amount DTH of the throttle opening is less than a second predetermined value (deceleration-determining predetermined value) DTHa (i.e., when the deceleration is instructed to the engine 30); and a trim-down stopper (ECU 110, S14, S302, S306) adapted to stop the trim-down operation when the trim angle θ becomes the initial angle after the trim-down operation is started by the trim-down starter. With this, it becomes possible to return the trim angle θ to the initial angle at the right time in accordance with the operating condition of the outboard motor 10.

An outboard motor control apparatus according to a second embodiment of the invention will be explained.

Figure 12:
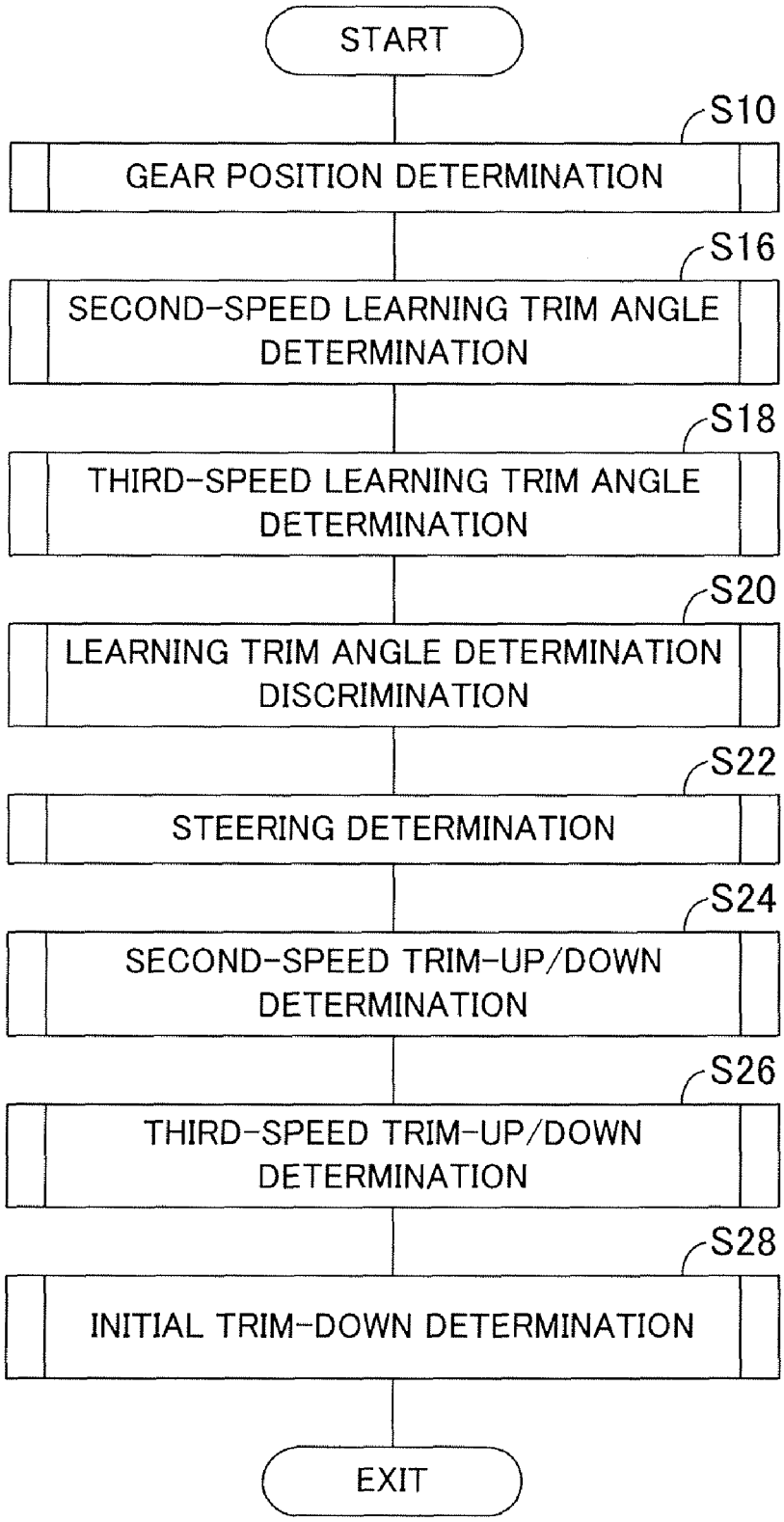
FIG. 12 is a flowchart showing transmission control operation and trim angle control operation by an electronic control unit of an outboard motor control apparatus according to a second embodiment of the invention.

FIG. 12 is a flowchart similar to FIG. 6, but showing alternative examples of transmission control operation and trim angle control operation by the ECU 110. Note that the change switch 126 is positioned at the automatic speed change mode here.

The program begins at S10, in which the operation for determining which one from among the first to third speeds of the transmission 46 should be selected, is conducted.

Figure 13:
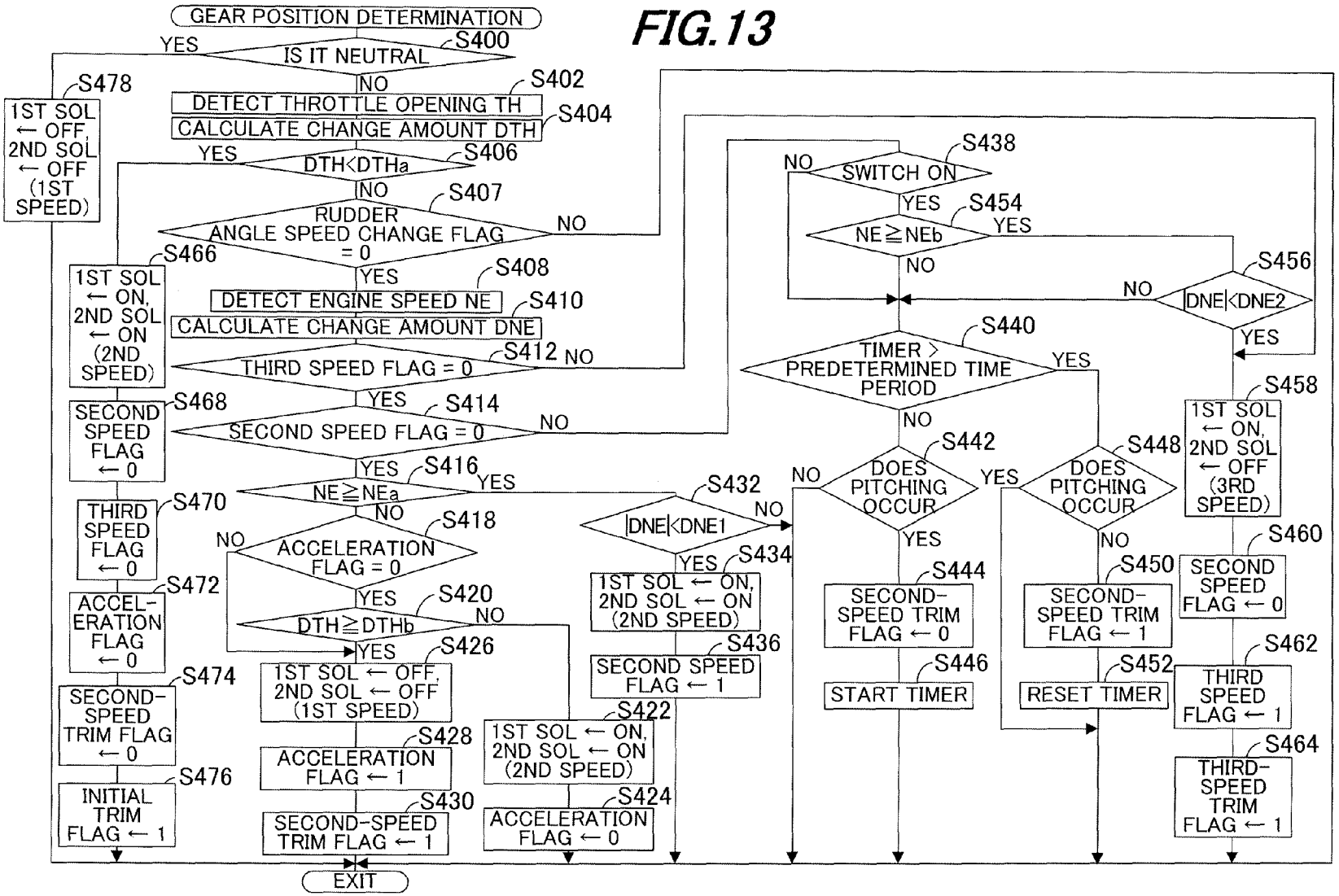
FIG. 13 is a subroutine flowchart showing the operation of gear position determination in the FIG. 12 flowchart.

FIG. 13 is a subroutine flowchart similar to FIG. 7, but showing the operation of the gear position determination.

The process of S400 to S406 is conducted similarly to S100 to S106 of the FIG. 7 flowchart.

When the result in S406 is negative, the program proceeds to S407, in which it is determined whether the bit of a rudder angle speed change flag indicating that the gear position is changed based on the rudder angle in the process which will be explained later, is 0. When the result in S407 is negative, since it is not necessary to change the gear position in this gear position determination operation, the remaining steps are skipped and when the result is affirmative, the program proceeds to S408, in which the engine speed NE is detected or calculated and to S410, in which the change amount (variation) DNE of the engine speed NE is detected or calculated.

Then the program proceeds to S412, in which, similarly to S108 in the FIG. 7 flowchart, it is determined whether the bit of the third speed flag is 0. The result in S412 in the first program loop is generally affirmative and the program proceeds to S414.

The process of S414 to S428 is conducted similarly to S114 to S128 of the FIG. 7 flowchart.

Next the program proceeds to S430, in which the bit of a second-speed trim flag (initial value 0) is set to 1 and the program is terminated. Specifically, the bit of this flag being set to 1 means that the change amount DTH is equal to or greater than the predetermined value DTHb, the transmission 46 is changed to the first speed, and the trim-up operation is to be conducted in the operation of second-speed trim-up/down determination (explained later), while that being reset to 0 means that the trim-up operation is not needed, i.e., for example, the deceleration is instructed to the engine 30.

After the transmission 46 is changed to the first speed, when the engine speed NE is increased and reaches the predetermined speed NEa, the result in S416 is affirmative and the program proceeds to S432.

The process of S432 to S436 is conducted similarly to S132 to S136 of the FIG. 7 flowchart.

When the bit of the second speed flag is set to 1 in S436, the result in S414 in the next and subsequent loops becomes negative and the program proceeds to S438. In S438, the process is conducted similarly to S142 in the FIG. 7 flowchart and when the result is negative, the program proceeds to S440, in which it is determined whether a value of a trim-up restart timer (described later) exceeds a value indicating a predetermined time period. Since the initial value of the timer is 0, the result here is negative and the program proceeds to S442, in which it is determined whether the pitching (vibration or shake in the vertical direction) of the hull 12 occurs.

The pitching occurrence is determined based on the output of the acceleration sensor 134, specifically, it is determined by detecting or calculating vibration acceleration Gz acting on the hull 12 in the vertical direction based on the output of the acceleration sensor 134, and determining whether an absolute value of the vibration acceleration Gz is within a permissible range. When the vibration acceleration Gz is determined to be out of the permissible range multiple (e.g., two) times sequentially, the pitching is determined to occur. The permissible range is set to a range (e.g., 0 to 0.5 G) as a criterion for determining whether the vertical vibration of the hull 12 is relatively small and no pitching occurs.

When the result in S442 is negative, the remaining steps are skipped and when the result is affirmative, the program proceeds to S444, in which the bit of the second-speed trim flag is reset to 0. Consequently, the trim-up operation is stopped through the operation of the second-speed trim-up/down determination (explained later). Then, in S446, the trim-up restart timer (up counter) is started to measure an elapsed time since the trim-up operation is stopped.

In the next and ensuing program loops, when the result in S440 is affirmative, the program proceeds to S448, in which, similarly to S442, the pitching determination is again made. When the result in S448 is negative, the program proceeds to S450, in which the bit of the second-speed trim flag is set to 1 and to S452, in which the timer value is reset to 0. Consequently, the trim-up operation is restarted through the operation of the second-speed trim-up/down determination (explained later). The predetermined time period is set as a criterion (e.g., 5 seconds) for determining whether the halted trim-up operation can be restarted (because there should be no pitching anymore). When the result in S448 is affirmative, S450 and S452 are skipped.

On the other hand, when the result in S438 is affirmative, the program proceeds to S454, and up to S462, the process is conducted similarly to S144 to S152 of the FIG. 7 flowchart.

Then the program proceeds to S464, in which the bit of a third-speed trim flag (initial value 0) is set to 1. The bit of this flag being set to 1 means that the gear position is changed to the third speed and the trim-down operation is to be conducted in the operation of third-speed trim-up/down determination (explained later), while that being reset to 0 means that the trim-down operation is not needed or was completed. Note that, in a program loop after the bit of the third speed flag is set to 1 in S462, the result in S412 is negative and the process of S458 to S464 is conducted, whereafter the program is terminated with the third speed being maintained. When the result in S406 is affirmative, the program proceeds to S466, and up to S472, the process is conducted similarly to S154 to S160 of the FIG. 7 flowchart.

Next the program proceeds to S474, in which the bit of the second-speed trim flag is reset to 0 and to S476, in which the bit of an initial trim flag (initial value 0) is set to 1. The bit of the initial trim flag being set to 1 means that it is necessary to regulate the trim angle θ back to the initial angle (0 degree) through the operation of initial trim-down determination (explained later), while that being reset to 0 means that it is not necessary.

When the result in S400 is affirmative, the program proceeds to S478, in which the first and second solenoid valves 86*a*, 86*b* are both made OFF to change the transmission 46 from the second speed to the first speed.

Returning to the explanation on the FIG. 12 flowchart, the program proceeds to S16, in which a trim angle when the gear position is in the second speed and the boat speed reaches the maximum speed is learned or stored to determine a second-speed learning trim angle δ, and to S18, in which a trim angle when the gear position is in the third speed and the boat speed reaches the maximum speed is learned or stored to determine a third-speed learning trim angle c.

Figure 14:
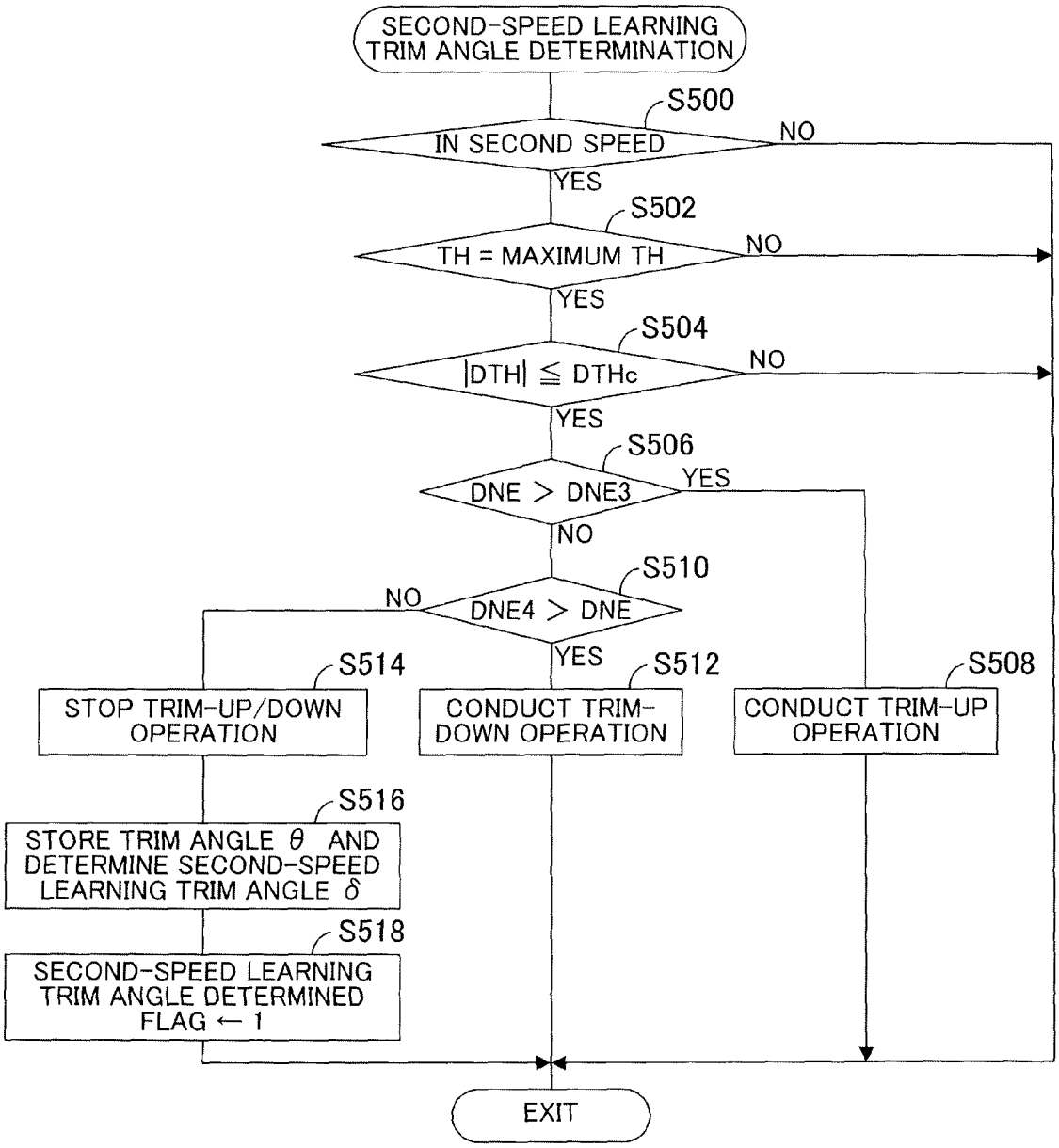
FIG. 14 is a subroutine flowchart showing the operation of second-speed learning trim angle determination in the FIG. 12 flowchart.
Figure 15:
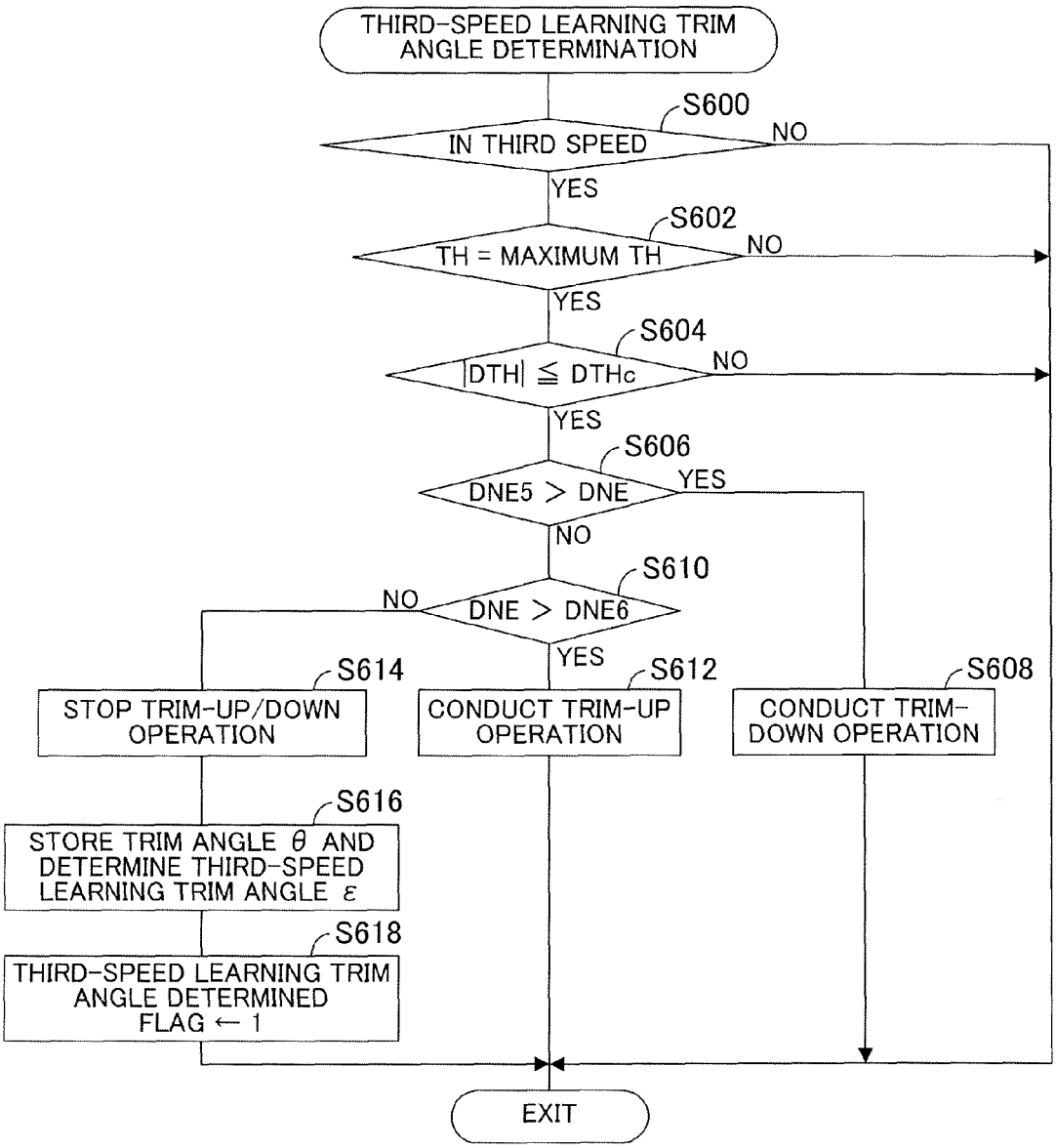
FIG. 15 is a subroutine flowchart showing the operation of third-speed learning trim angle determination in the FIG. 12 flowchart.

FIG. 14 is a subroutine flowchart showing the operation of the second-speed learning trim angle determination and FIG. 15 is a subroutine flowchart showing the operation of the third-speed learning trim angle determination.

As shown in FIG. 14, in S500, it is determined whether the present gear position is in the second speed. When the result in S500 is negative, the remaining steps are skipped and when the result is affirmative, the program proceeds to S502, in which it is determined whether the throttle opening TH is the maximum opening.

When the result in S502 is affirmative, the program proceeds to S504, in which it is determined whether the throttle opening TH is stable (i.e., does not vary). Specifically, when an absolute value of the change amount DTH of the throttle opening TH is equal to or less than a change amount determining predetermined value DTHc, the throttle opening TH is determined to be stable. The predetermined value DTHc is set as a criterion (e.g., 2 degrees) for determining whether the throttle opening TH is stable, i.e., the change amount DTH is relatively small.

When the result in S504 or S502 is negative, the remaining steps are skipped. When the result in S504 is affirmative, i.e., when the throttle opening TH is stable at the maximum opening so that the engine 30 is in the operating condition capable of making the boat speed reach the maximum speed, the program proceeds to S506, in which it is determined whether the change amount DNE of the engine speed NE is greater than a third prescribed value DNE3 set to a positive value (e.g., 500 rpm).

When the process of S506 is first conducted, since it is immediately after the engine 30 is determined to be in the aforementioned operating condition in S504, the change amount DNE is large on the positive side. Therefore, the result is generally affirmative and the program proceeds to S508, in which the trim unit 24 is operated to start and conduct the trim-up operation, thereby increasing the boat speed.

When the result in S506 is negative, the program proceeds to S510, in which it is determined whether the change amount DNE is less than a fourth prescribed value DNE4 set to a negative value (e.g., −500 rpm). When the result in S510 is affirmative, it means that the trim angle θ has become excessive due to the trim-up operation in S508 for example. Hence, the program proceeds to S512, in which the trim angle θ is appropriately regulated through the trim-down operation.

When the result in S510 is negative, i.e., when the change amount DNE is within a predetermined range between the third prescribed value DNE3 and the fourth prescribed value DNE4 (DNE4≦DNE≦DNE3), it is determined or estimated that the engine speed NE is saturated in the high speed range and the boat speed is at or about the maximum speed, and the program proceeds to S514, in which the trim-up (or trim-down) operation is stopped. The predetermined range is set as a criterion for determining that the boat speed has reached the maximum speed.

The program proceeds to S516, in which the present trim angle θ is detected based on the output of the trim angle sensor 104, i.e., the trim angle θ at the time when the trim-up operation is stopped (e.g., 10 degrees) is detected and stored, and the stored trim angle θ is determined as the second-speed learning trim angle δ (explained later). Then the program proceeds to S518, in which the bit of a second-speed learning trim angle determined flag (initial value 0) is set to 1, whereafter the program is terminated. The bit of this flag being set to 1 means that the second-speed learning trim angle δ is determined.

Next, the operation of the third-speed learning trim angle determination in FIG. 15 is explained. In S600, it is determined whether the present gear position is in the third speed. When the result in S600 is negative, the remaining steps are skipped and when the result is affirmative, the program proceeds to S602, in which it is determined whether the throttle opening TH is the maximum opening.

When the result in S602 is affirmative, the program proceeds to S604, in which it is determined whether an absolute value of the change amount DTH of the throttle opening TH is equal to or less than the predetermined value DTHc. Similarly to S502 and S504 described above, the process of S602 and S604 is conducted to determine whether the throttle opening TH is stable at the maximum opening and the engine 30 is in the operating condition capable of making the boat speed reach the maximum speed.

When the result in S602 or S604 is negative, the remaining steps are skipped. When the result in S604 is affirmative, the program proceeds to S606, in which it is determined whether the change amount DNE is less than a fifth prescribed value DNE5 set to a negative value (e.g., −500 rpm).

When the process of S606 is first conducted, since it is immediately after the gear position is changed (shifted up) to the third speed and the affirmative result is made in S600, the change amount DNE is large on the negative side. Therefore, the result in S606 is generally affirmative and the program proceeds to S608, in which the trim unit 24 is operated to start and conduct the trim-down operation. In the case where it is immediately after the gear position is changed from the second speed to the third speed, the boat speed is increased by regulating the trim angle θ established in the second speed to slightly decrease through the trim-down operation.

When the result in S606 is negative, the program proceeds to S610, in which it is determined whether the change amount DNE is greater than a sixth prescribed value DNE6 set to a positive value (e.g., 500 rpm). When the result in S610 is affirmative, it means that the trim angle θ has become too small due to the trim-down operation in S608 for example. Hence, the program proceeds to S612, in which the trim angle θ is appropriately regulated through the trim-up operation.

When the result in S610 is negative, i.e., when the change amount DNE is within a second predetermined range between the fifth prescribed value DNE5 and the sixth prescribed value DNE6 (DNE5≦DNE≦DNE6), it is determined or estimated that the engine speed NE is saturated in the high speed range and the boat speed is at or about the maximum speed, and the program proceeds to S614, in which the trim-down (or trim-up) operation is stopped. The second predetermined range is set as a criterion for determining that the boat speed has reached the maximum speed.

The program proceeds to S616, in which the present trim angle θ, i.e., the trim angle θ at the time when the trim-down operation is stopped (e.g., 8 degrees) is detected and stored, and the stored trim angle θ is determined as the third-speed learning trim angle ϵ (explained later). Then the program proceeds to S618, in which the bit of a third-speed learning trim angle determined flag (initial value 0) is set to 1, whereafter the program is terminated. The bit of this flag being set to 1 means that the third-speed learning trim angle ϵ is determined The further explanation is made on the above process of S16 and S18. Depending on whether the gear position is in the second speed or third speed, the appropriate trim angle that enables the boat speed to reach the maximum speed is different. Concretely, the appropriate trim angle in the third speed is to be slightly smaller than that in the second speed. Therefore, in S16 and S18, the appropriate trim angles in the second and third speeds are set by conducting the trim-up/down operation based on the change amount DNE, and the thus-obtained appropriate trim angles are stored as learning values. As described below, the learning values are utilized in the next and subsequent operation in the second and third speeds. Note that the second-speed and third-speed learning trim angles δ, ϵ are determined only one time after the engine start, in other words, once the learning trim angles δ, ϵ are determined, the operation of second-speed and third-speed learning trim angle determination is not conducted.

Figure 16:
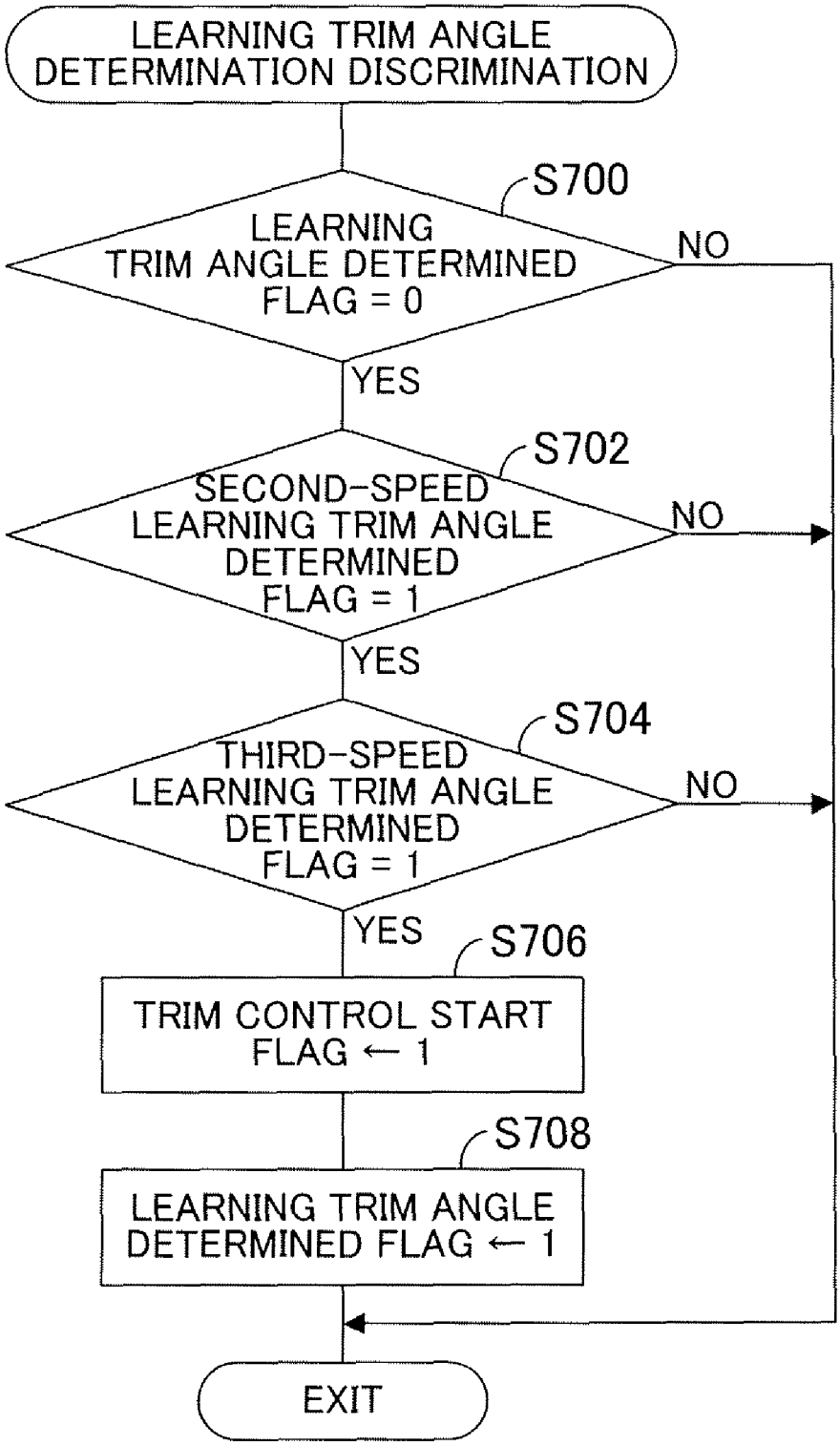
FIG. 16 is a subroutine flowchart showing the operation of learning trim angle determination discrimination in the FIG. 12 flowchart.

Returning to the explanation on the FIG. 12 flowchart, the program proceeds to S20, in which it is discriminated whether the learning trim angles δ, ϵ are determined FIG. 16 is a subroutine flowchart showing the operation of the learning trim angle determination discrimination. As shown in FIG. 16, in S700, it is determined whether the bit of a learning trim angle determined flag indicating that the learning trim angles δ, ϵ have been determined is 0. Since the initial value of this flag is 0, the result in S700 in the first program loop is generally affirmative and the program proceeds to S702.

In S702, it is determined whether the bit of the second-speed learning trim angle determined flag is 1. When the result in S702 is affirmative, the program proceeds to S704, in which it is determined whether the bit of the third-speed learning trim angle determined flag is 1. When the result in S704 or S702 is negative, the remaining steps are skipped and when the result in S704 is affirmative, the program proceeds to S706, in which the bit of a trim control start flag (initial value 0) is set to 1. The bit of this flag being set to 1 means that the trim angle control using the learning trim angles δ, ϵ (explained later) can be started or is permitted, while being reset to 0 means that the control can not be started or is not permitted.

Then the program proceeds to S708, in which the bit of the learning trim angle determined flag is set to 1 and the program is terminated. Upon setting of the bit of this flag to 1, the result in S700 in the next and subsequent loops becomes negative and the steps of S702 to S708 are skipped. When the outboard motor 10 is powered off by the operator, the bits of the trim control start flag and learning trim angle determined flag are reset to 0.

Returning to the explanation on the FIG. 12 flowchart, the program proceeds to S22, in which it is determined whether the trim angle θ should be regulated in response to the start of steering of the outboard motor 10. A term of "steering" in the embodiments is sometimes used to express changing of the course of the boat 1 in response to the manipulation of the steering wheel 114.

Figure 17:
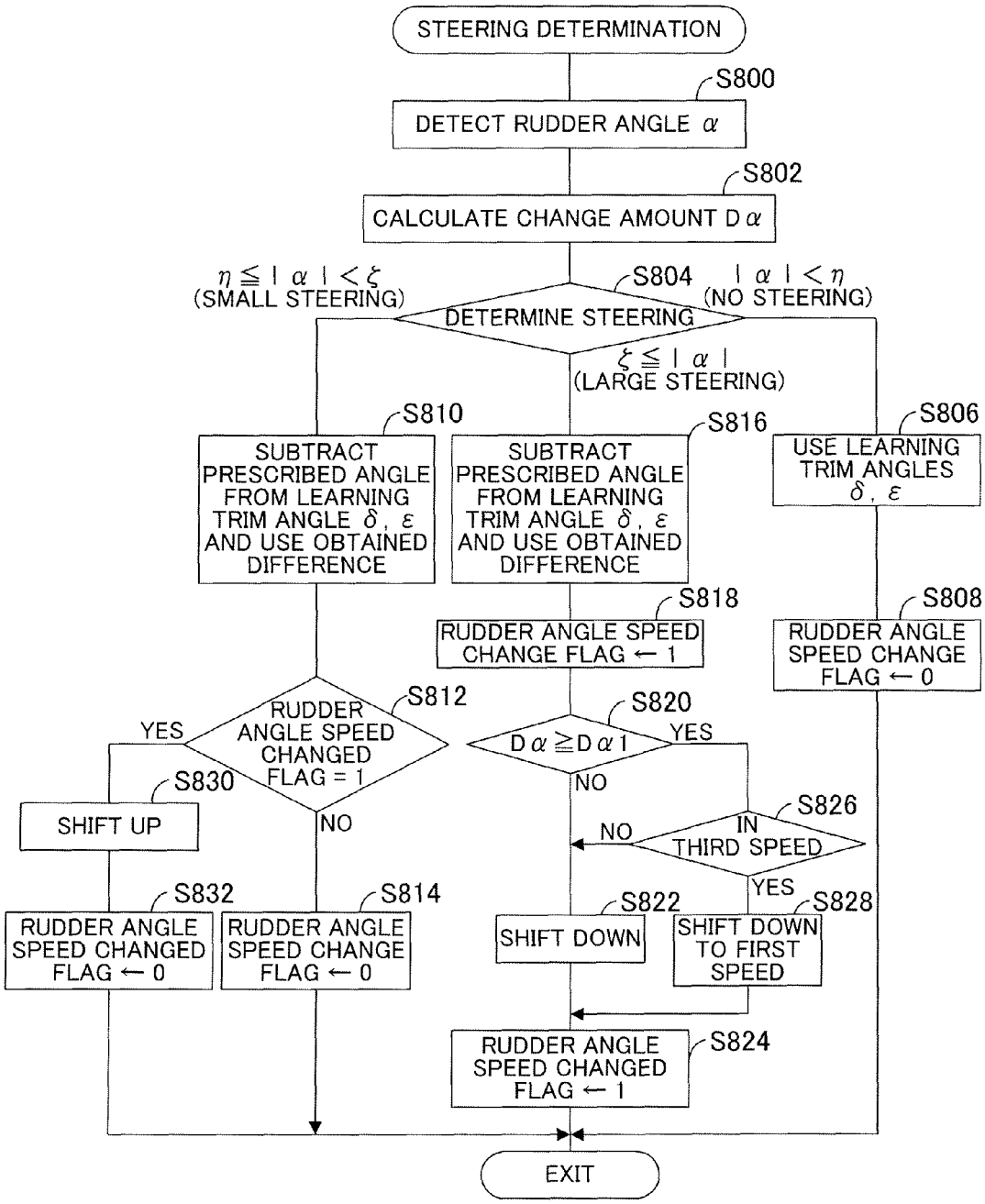
FIG. 17 is a subroutine flowchart showing the operation of steering determination in the FIG. 12 flowchart.

FIG. 17 is a subroutine flowchart showing the operation of the steering determination. In S800, the rudder angle α is detected or calculated from the output of the rudder angle sensor 106, and in S802, a change amount (variation) Dα of an absolute value of the detected rudder angle α per unit time (e.g., 500 milliseconds) is calculated.

The program proceeds to S804, in which based on the detected rudder angle α, it is determined whether the steering is started so that cavitation likely occur. In the case where the steering has been started, the degree of the steering is determined. To be specific, when the absolute value of the rudder angle α is less than a first predetermined rudder angle η set to a relatively small value (e.g., 5 degrees), it is determined that no steering or slight steering occurs and the program proceeds to S806, in which the second-speed and third-speed learning trim angles δ, ϵ are directly used in the trim angle regulating process (i.e., second-speed and third-speed trim-up/down determination; explained later). Then the program proceeds to S808, in which the bit of the rudder angle speed change flag is reset to 0 and the program is terminated.

In S804, when the absolute value of the rudder angle α is equal to or greater than the first predetermined rudder angle η and less than a second predetermined rudder angle ζ (e.g., 10 degrees) set greater than the first predetermined rudder angle η, it is determined that, although the steering is started so that cavitation likely occur, the steering is relatively small. The program proceeds to S810, in which a prescribed angle (e.g., 3 degrees) is subtracted from each of the learning trim angles δ, ϵ and the obtained differences are used in the trim angle regulating process.

Owing to the above configuration, when the trim angle θ is the second-speed learning trim angle δ for example, the trim-down operation is started to decrease the trim angle θ in the trim angle regulating process. Thus, when the steering is started, the trim angle θ is decreased based on the rudder angle α, thereby preventing cavitation occurrence.

Next, the program proceeds to S812, in which it is determined whether the bit of a rudder angle speed changed flag is 1. Since the initial value of this flag is 0, the result is generally negative and the program proceeds to S814, in which the bit of the rudder angle speed change flag is reset to 0, whereafter the program is terminated.

When the absolute value of the rudder angle α is equal to or greater than the second predetermined rudder angle ζ in S804, it is determined that the relatively large steering is started and the program proceeds to S816, in which, similarly to S810, the prescribed angle is subtracted from each of the learning trim angles δ, ϵ and the obtained differences are used in the trim angle regulating process. As a result, the trim angle θ is decreased to prevent cavitation occurrence.

Further, in the case where the steering is large, since the decrease in the boat speed leads to the smooth turn of the boat 1, the transmission 46 is further shifted down in the following process. Specifically, in S818, the bit of the rudder angle speed change flag is set to 1. The bit of this flag being set to 1 means that the gear position is changed based on the rudder angle α, while that being reset to 0 means that the gear position is not changed.

Then the program proceeds to S820, in which it is determined whether the steering of this time is sharply conducted (i.e., it is the sharp steering). This determination is made based on the change amount Dα of the rudder angle α. More specifically, when the change amount Dα is equal to or greater than a threshold value Dα1 used for determining the sharp steering, the steering of this time is determined to be the sharp one. The threshold value Dα1 is set as a criterion (e.g., 10 degrees) for determining whether it is the sharp steering.

When the result in S820 is negative, the program proceeds to S822, in which the operation of the first and second solenoid valves 86*a*, 86*b* is controlled to shift down the gear position, precisely, to the first speed in the case of the second speed and to the second speed in the case of the third speed. The program proceeds to S824, in which the bit of the rudder angle speed changed flag is set to 1. The bit of this flag being set to 1 means that the transmission 46 is shifted down based on the rudder angle α, and otherwise, reset to 0.

When the result in S820 is affirmative, the program proceeds to S826, in which it is determined whether the present gear position is in the third speed. When the result in S826 is negative, the program proceeds to the aforementioned step of S822, while, when the result is affirmative, proceeding to S828, in which the gear position is shifted down from the third speed to the first speed. Subsequently the process of S824 is conducted and the program is terminated.

Further, in a program loop after the subtraction is done with the learning trim angles δ, ϵ in S816 and the transmission 46 is shifted down in S822 or S828, when the steering is finished and the steering wheel 114 is returned to the initial position by the operator so that the rudder angle α is gradually decreased to a value below the second predetermined rudder angle ζ, in S804, it is determined that the steering is relatively small and the program proceeds to S810.

Since the learning trim angles δ, ϵ have been reduced in S816, the program proceeds to S812 without further subtraction. In S812, the result is affirmative and the program proceeds to S830, in which the transmission 46 which has been shifted down in response to the steering is shifted up to change the gear position back to the speed of before the shift down operation. Thus, after the steering is finished, the transmission 46 is shifted up based on the decrease in the rudder angle α. Then the program proceeds to S832, in which the bit of the rudder angle speed changed flag is reset to 0.

When the rudder angle α is further decreased to a value below the first predetermined rudder angle η, since it is not necessary to decrease the trim angle θ, the program proceeds to S804 to S806, in which the decreased learning trim angles δ, ϵ are returned to the original values. As a result, the trim-up operation is started in the trim angle regulating process so that the trim angle θ is increased. Thus, after the transmission 46 is shifted up in S830, the trim angle θ is increased based on the decrease in the rudder angle α.

Returning to the explanation on the FIG. 12 flowchart, the program proceeds to S24, in which it is determined whether the gear position is in the second speed and the trim-up/down operation should be conducted, and to S26, in which it is determined whether the gear position is in the third speed and the trim-up/down operation should be conducted.

Figure 18:
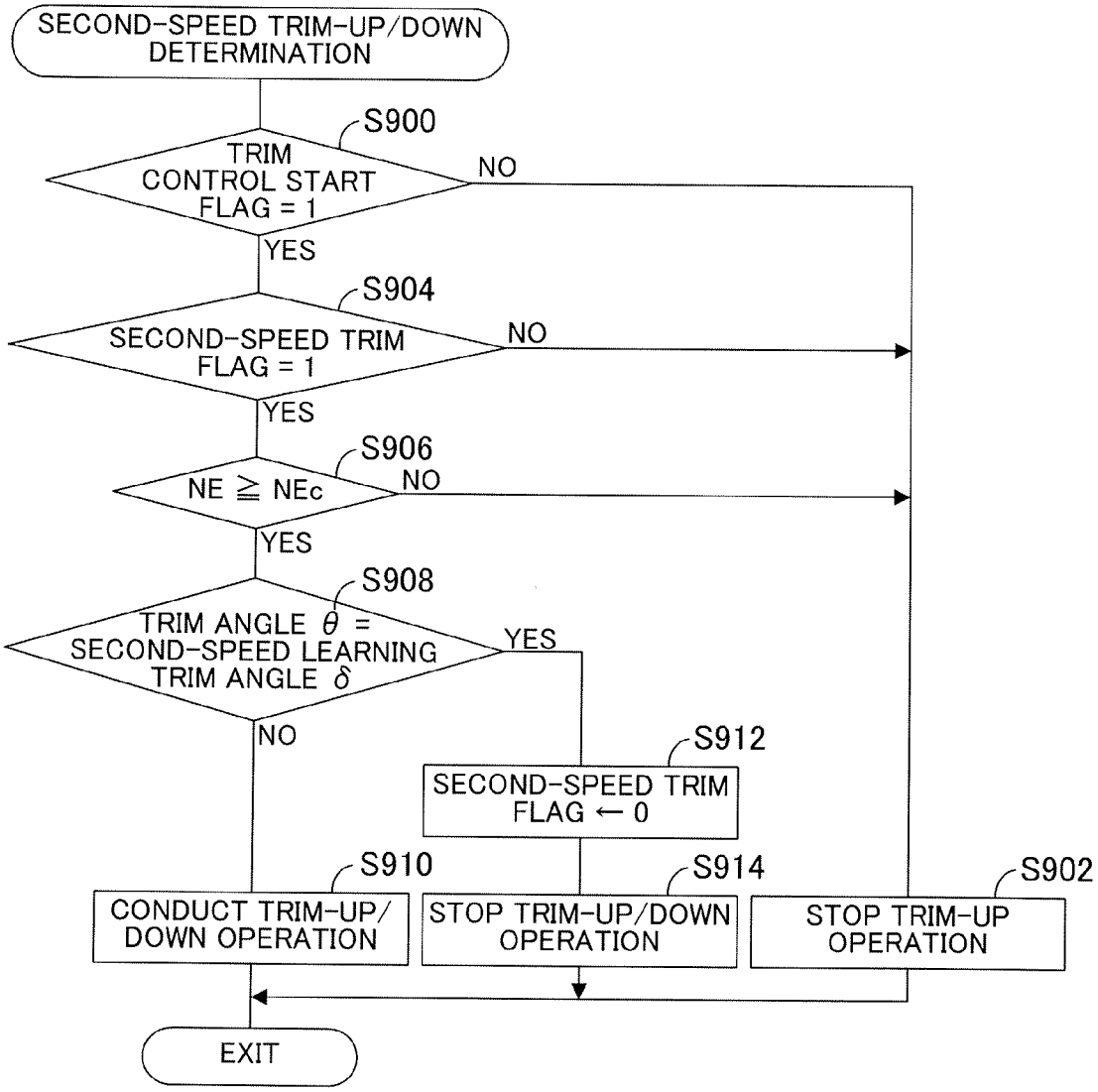
FIG. 18 is a subroutine flowchart showing the operation of second-speed trim-up/down determination in the FIG. 12 flowchart.
Figure 19:
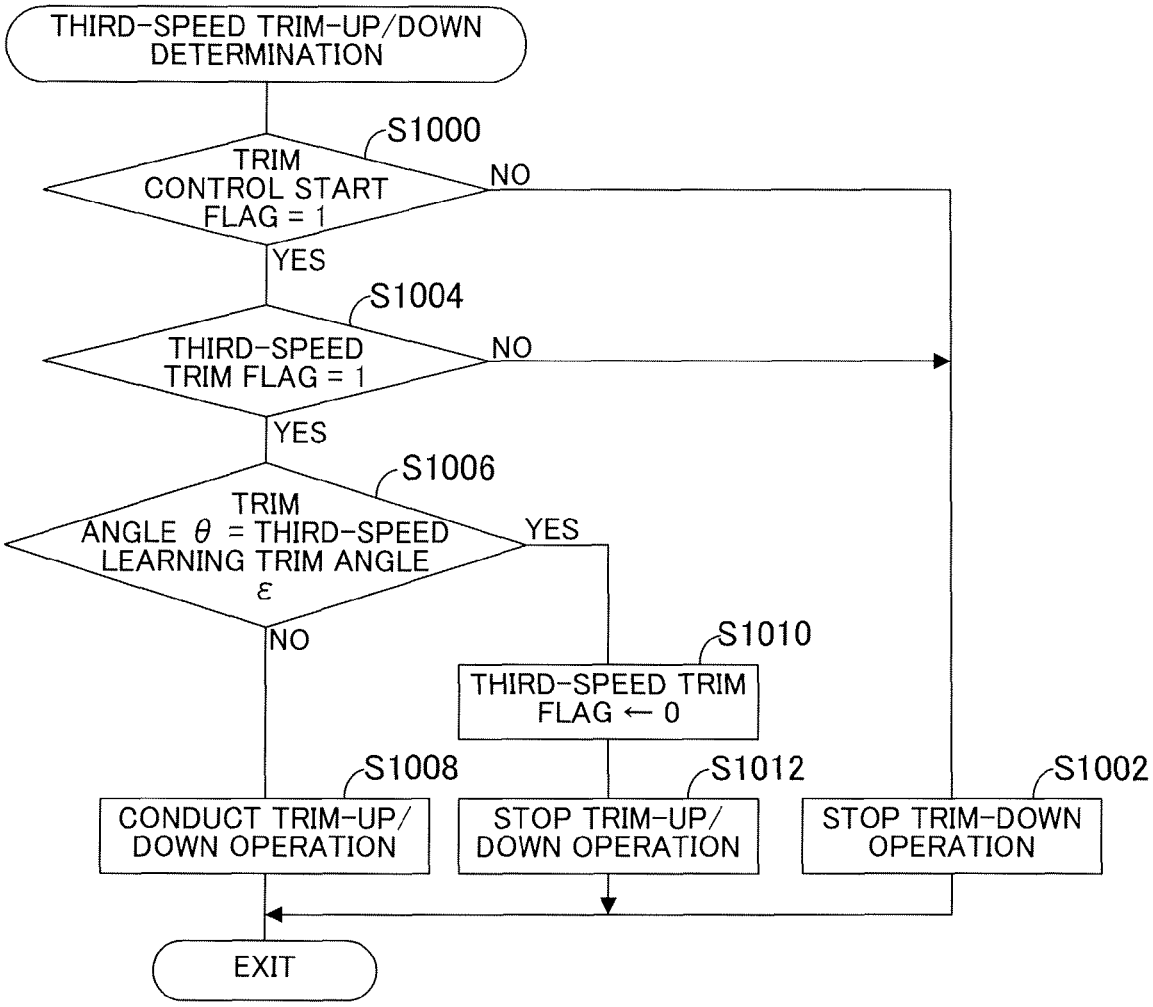
FIG. 19 is a subroutine flowchart showing the operation of third-speed trim-up/down determination in the FIG. 12 flowchart.

FIG. 18 is a subroutine flowchart showing the operation of the second-speed trim-up/down determination and FIG. 19 is a subroutine flowchart showing the operation of the third-speed trim-up/down determination.

As shown in FIG. 18, in S900, it is determined whether the bit of the trim control start flag is 1. When the result in S900 is negative, the program proceeds to S902, in which the trim-up operation is stopped, i.e, not conducted.

In S900, it is also determined whether the trim angle regulation command is outputted from the trim switch 130 upon the manipulation by the operator. When the command is outputted, regardless of the bit of the trim control start flag, the operation of the trim unit 24 is controlled in response to the command so as to regulate the trim angle θ. Thus the operator can regulate the trim angle θ anytime by manipulating the trim switch 130. This control is called the manual trim angle control. The trim angle regulation to be performed by a "second trim angle controller" described in claims corresponds to the regulation through this manual trim angle control.

When the result in S900 is affirmative, the program proceeds to S904, in which it is determined whether the bit of the second-speed trim flag is 1. When the result in S904 is negative, since it means that the trim-up operation is not needed, the program proceeds to S902, in which the trim-up operation is not conducted. When the result in S904 is affirmative (e.g., when the acceleration is instructed to the engine 30 so that the gear position is changed to the first speed), the program proceeds to S906, in which it is determined whether the engine speed NE is equal to or greater than the trim-up predetermined speed NEc.

When the result in S906 is negative, since it is not the time to start the trim-up operation, the program proceeds to S902 and the program is terminated without conducting the trim-up operation. On the other hand, when the result in S906 is affirmative, the program proceeds to S908, in which it is determined whether the trim angle θ is the second-speed learning trim angle δ.

When the result in S908 is negative, the program proceeds to S910, in which the trim unit 24 is operated to start and conduct the trim-up or trim-down operation. In the case where the process of S910 is first conducted, since the trim angle θ is generally 0 degree, the trim-up operation is conducted. Thus the trim-up operation is started before the acceleration is completed and the transmission 46 is changed back from the first speed to the second speed, thereby increasing the boat speed.

After the trim angle θ is regulated through the trim-up operation, when the result in S908 in the next program loop is affirmative, the program proceeds to S912, in which the bit of the second-speed trim flag is reset to 0 and to S914, in which the trim-up or trim-down operation is stopped. Thus, when the gear position is in the second speed, the trim angle θ is converged to the learning trim angle δ, thereby making the boat speed reach the maximum speed.

Further, in a program loop after the prescribed angle is subtracted from the learning trim angle δ in the foregoing process of S810 or S816, the result in S908 is negative and the program proceeds to S910, in which the trim-down operation is conducted until the trim angle θ becomes the reduced learning trim angle δ. Also when the steering of the outboard motor 10 is finished and the learning trim angle δ is returned to the original value, the result in S908 is negative and the program proceeds to S910, in which the trim-up operation is conducted until the trim angle θ becomes the returned learning trim angle δ.

Next, the operation of the third-speed trim-up/down determination in FIG. 19 is explained. In S1000, it is determined whether the bit of the trim control start flag is 1. When the result in S1000 is negative, the program proceeds to S1002, in which the trim-down operation is stopped, i.e, not conducted.

When the result in S1000 is affirmative, the program proceeds to S1004, in which it is determined whether the bit of the third-speed trim flag is 1. When the result in S1004 is negative, since it means that the trim-down operation is not needed, the program proceeds to S1002, in which the trim-down operation is not conducted. When the result in S1004 is affirmative, i.e., when the gear position is changed to the third speed, the program proceeds to S1006, in which it is determined whether the trim angle θ is the third-speed learning trim angle ϵ.

When the result in S1006 is negative, the program proceeds to S1008, in which the trim unit 24 is operated to start and conduct the trim-down or trim-up operation. In the case where the process of S1008 is first conducted, the trim angle θ is generally at the second-speed learning trim angle δ greater than the third-speed learning trim angle ϵ, the trim-down operation is conducted here. After the trim angle θ is regulated through the trim-down operation, when the result in S1006 in the next program loop is affirmative, the program proceeds to S1010, in which the bit of the third-speed trim flag is reset to 0 and to S1012, in which the trim-down operation is stopped. Thus, after the third-speed learning trim angle ϵ is determined, the trim-down operation is started when the transmission 46 is changed to the third speed, so that the trim angle θ is converged to the learning trim angle ϵ, thereby making the boat speed reach the maximum speed.

Further, in a program loop after the prescribed angle is subtracted from the learning trim angle ϵ in the foregoing process of S810 or 816, the result in S1006 is negative and the program proceeds to S1008, in which the trim-down operation is conducted until the trim angle θ becomes the reduced learning trim angle ϵ. Also when the steering of the outboard motor 10 is finished and the learning trim angle ϵ is returned to the original value, the result in S1006 is negative and the program proceeds to S1008, in which the trim-up operation is conducted until the trim angle θ becomes the returned learning trim angle ϵ.

Returning to the explanation on the FIG. 12 flowchart, the program proceeds to S28, in which it is determined whether the trim-down operation for regulating the trim angle θ back to the initial angle should be conducted.

Figure 20:
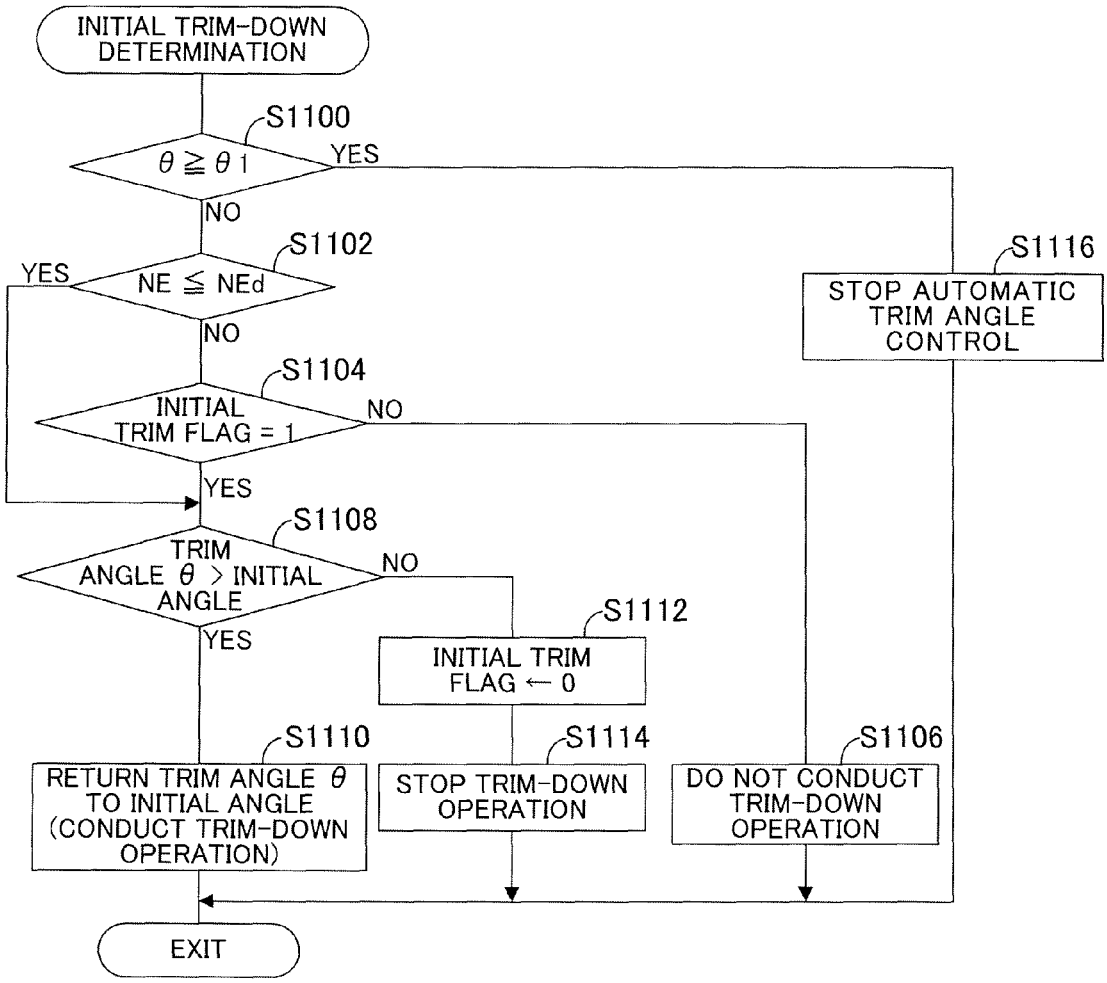
FIG. 20 is a subroutine flowchart showing the operation of initial trim-down determination in the FIG. 12 flowchart.

FIG. 20 is a subroutine flowchart showing the operation of the initial trim-down determination. In S1100, it is determined whether the trim angle θ is equal to or greater than a predetermined angle θ1 and in a tilt range. This process will be explained later.

When the result in S1100 is negative, the program proceeds to S1102, in which it is determined whether the engine 30 is in an idle condition. This determination is made by comparing the engine speed NE with an idle determining predetermined speed NEd and when it is equal to or less than the predetermined speed NEd, the engine 30 is determined to be in the idle condition. The predetermined speed NEd is set to a relatively low value (e.g., 200 rpm) as a criterion for determining whether the engine 30 is in the idle condition.

When the result in S1102 is negative, the program proceeds to S1104, in which it is determined whether the bit of an initial trim flag is 1. When the result in S1104 is negative, the program proceeds to S1106, in which the trim-down operation is not conducted. When the result in S1104 is affirmative, the program proceeds to S1108, in which it is determined whether the trim angle θ is greater than the initial angle. When the result in S1102 is affirmative, the program also proceeds to S1108.

When the result in S1108 is affirmative, the program proceeds to S1110, in which the trim unit 24 is operated to conduct the trim-down operation to regulate or return the trim angle θ to the initial angle. When the result in S1108 is negative, i.e., when the trim angle θ is equal to the initial angle, the program proceeds to S1112, in which the bit of the initial trim flag is reset to 0 and to S1114, in which the trim-down operation is stopped and the program is terminated.

As described in the foregoing, the apparatus according to this embodiment is configured to conduct the transmission control of the transmission 46 based on the engine speed NE, throttle opening TH, etc., and control the operation of the trim unit 24 based on the transmission control to trim up/down the outboard motor 10, thereby regulating the trim angle θ. This control is called the automatic trim angle control. The trim angle regulation to be performed by a "first trim angle controller" described in claims corresponds to the regulation through this automatic trim angle control. The abovementioned manual trim angle control has a priority to the automatic trim angle control.

The process in S1100 is now explained in detail. In the case where, for instance, the operation of the boat 1 is finished and the boat 1 is to be landed, the up switch of the trim switch 130 is pressed by the operator so that the trim angle regulation command (trim-up command) is outputted and in response thereto, the outboard motor 10 is trimmed up to a certain trim angle (i.e., tilt range) through the manual trim angle control so as not to interfere with the ground.

The step of S1100 is processed for determining whether such the trim-up operation of the outboard motor 10 is conducted, more specifically, determining whether the trim angle θ becomes equal to or greater than the predetermined angle θ1 through the manual trim angle control when the trim angle regulation command is outputted from the trim switch 130. Therefore, the predetermined angle θ1 is set to a value (e.g., 20 degrees) appropriate for landing the boat 1, i.e., a value enables the propeller 42 or the like not to interfere (contact) with the ground when landing.

When the result in S1100 is affirmative, the program proceeds to S1116, in which the automatic trim angle control implemented based on the transmission control of the transmission 46 is stopped. Accordingly, only the manual trim angle control becomes effective and the outboard motor 10 can avoid being trimmed down to make the trim angle θ return to the initial angle through the automatic trim angle control.

FIG. 21 is a time chart for explaining the operation of the outboard motor 10 described in the flowcharts in FIGS. 12 to 20 in the cases where the steering is conducted and where the boat 1 is landed, with reference to FIG. 11. The following description is made on the premise that the learning trim angles δ, ϵ are already defined in S16 and S18.

The explanation on the time t0 to t1 is omitted here, as it is the same as in the first embodiment.

After the gear position is changed to the first speed at the time t1, when the acceleration is continued so that the engine speed NE is gradually increased and reaches the predetermined speed NEc or more at the time t2, the trim-up operation of the outboard motor 10 is started (S906, S910). Subsequently, when the engine speed NE is further increased and becomes equal to or greater than the predetermined speed NEa (S416, time t3), the gear position is changed from the first speed to the second speed (S434). Then, when, at the time t4, the trim angle θ reaches the second-speed learning trim angles δ, the trim-up operation is stopped (S908, S914).

When the steering is started and, at the time t5, the rudder angle α becomes equal to or greater than the first predetermined rudder angle η, the prescribed angle is subtracted from the learning trim angle δ and based on the obtained difference, the trim angle θ is decreased (S804, S810). After that, when, at the time t6, the rudder angle α becomes equal to or greater than the second predetermined rudder angle ζ, the gear position is shifted down from the second speed to the first speed (S804, S822).

After that, when the steering is finished and, at the time t7, the rudder angle α becomes less than the second predetermined rudder angle ζ, the gear position is shifted up from the first speed to the second speed (S804, S830) and when, at the time t8, the rudder angle α becomes less than the first predetermined rudder angle η, the reduced learning trim angle δ is made back to the original value to increase the trim angle θ (S804, S806).

When the fuel consumption decreasing command is inputted by the operator through the switch 136 (S438) and, at the time t9, the engine speed NE is equal to or greater than the predetermined speed NEb (S454), the gear position is changed from the second speed to the third speed (S458) and the trim-down operation is started (S1006, S1008). Then, when, at the time t10, the trim angle θ reaches the third-speed learning trim angle ϵ, the trim-down operation is stopped (S1006, S1012).

Although not illustrated, when the trim-down operation is stopped, similarly to the condition shown in FIG. 11C, the axis line 44*a* of the propeller shaft 44 is positioned substantially parallel with the traveling direction of the boat 1, thereby enabling the boat speed in the third speed to reach the maximum speed.

When, at the time t11, the lever 122 is manipulated by the operator and the change amount DTH is less than the predetermined value DTHa (S406), the gear position is changed from the third speed to the second speed (S466) and the trim-down operation is started to regulate the trim angle θ to the initial angle (S1108, S1110). FIG. 11D is a view showing the condition where the trim angle θ has been returned to the initial angle.

In the case where the sharp steering is conducted with the transmission 46 in the third speed (from the time t10 to t11), as indicated by imaginary lines in FIG. 21, when, at the time ta, the rudder angle α becomes equal to or greater than the first predetermined rudder angle η, the prescribed angle is subtracted from the third-speed learning trim angle ϵ, thereby decreasing the trim angle θ (S804, S810). After that, when, at the time tb, the rudder angle α becomes equal to or greater than the second predetermined rudder angle ζ and it is determined to be the sharp steering (S804, S820, S826), the gear position is shifted down from the third speed to the first speed (S828).

Figure 11E:
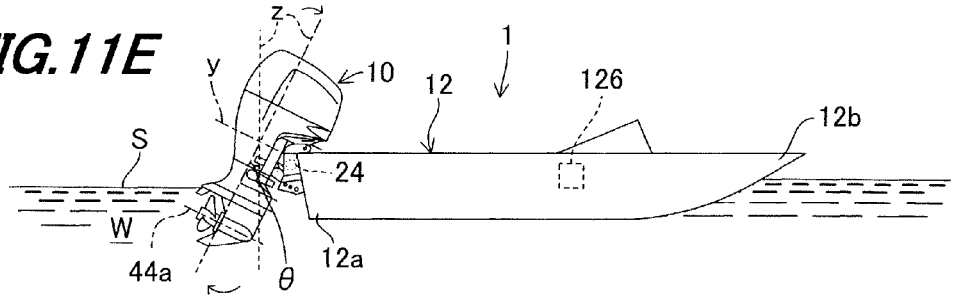

In the case where the boat 1 is landed, when, at the time 12, the up switch of the trim switch 130 is manipulated by the operator so that the trim angle regulation command (trim-up command) is outputted, the outboard motor 10 is trimmed up. At the time t13, when the trim angle θ becomes equal to or greater than the predetermined angle θ1 (S1100), it is estimated that the operation of the boat 1 is finished or the boat 1 is to be landed and consequently, the automatic trim angle control implemented based on the transmission control of the transmission 46 is stopped (S1116). The condition where the trim angle θ has been regulated to the predetermined angle θ1 is shown in FIG. 11E.

The remaining configuration is the same as that in the first embodiment.

As stated above, the first and second embodiments are configured to have an apparatus and a method for controlling operation of an outboard motor 10 adapted to be mounted on a stern 12*a* of a boat 1 and having an internal combustion engine 30 to power a propeller 42 through a drive shaft (input shaft 54) and a propeller shaft 44, a transmission 46 that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism (power tilt-trim unit) 24 regulating a trim angle θ relative to the boat 1 through trim-up/down operation, comprising: a throttle opening change amount detector (throttle opening sensor 96, ECU 110, S10, S104, S404) adapted to detect a change amount DTH of throttle opening TH of the engine; an engine speed detector (crank angle sensor 102, ECU 110, S10, S110, S408) adapted to detect speed of the engine (engine speed NE); a first-speed changer (ECU 110, S10, S120, S126, S420, S426) adapted to change the gear position of the transmission 46 from the second speed to the first speed when the gear position is in the second speed and the detected change amount DTH of the throttle opening is equal to or greater than a predetermined value (acceleration-determining predetermined value) DTHb; a trim-up starter (ECU 110, S10, S12, S130, S200, S204, S208, S24, S430, S904, S906, S910) adapted to start the trim-up operation through the trim angle regulation mechanism 24 when the detected engine speed NE is equal to or greater than a first predetermined speed (trim-up predetermined speed) NEc after the gear position is changed to the first speed by the first-speed changer; a second-speed changer (ECU 110, S10, S116, S134, S416, S434) adapted to change the gear position from the first speed to the second speed when the detected engine speed NE is equal to or greater than a second predetermined speed (second-speed change predetermined speed) NEa set greater than the first predetermined speed NEc after the trim-up operation is started by the trim-up starter; and a trim-up stopper (ECU 110, S10, S12, S140, S200, S202, S24, S908, S914) adapted to stop the trim-up operation after the gear position is changed to the second speed by the second-speed changer.

Thus, when the second speed is selected and the change amount DTH is equal to or greater than the predetermined value DTHb, the transmission 46 is operated to change the second speed to the first speed and when the engine speed NE becomes equal to or greater than the first predetermined speed NEc, the trim unit 24 is operated to start the trim-up operation. After that, when the engine speed NE becomes equal to or greater than the second predetermined speed NEa set greater than the first predetermined speed NEc, the transmission 46 is changed from the first speed to the second speed. With this, it becomes possible to trim up the outboard motor 10 before the transmission 46 is changed from the first speed to the second speed, thereby increasing the boat speed. Therefore, even when the gear position is changed from the first speed to the second speed after the acceleration is completed and the torque to be transmitted to the propeller 42 is decreased, since the boat speed is still increased through the trim-up operation, it becomes possible to avoid giving a deceleration feel to the operator, i.e., mitigate the deceleration feel.

Further, since the trim-up operation is stopped after the transmission 46 is changed from the first speed to the second speed, the trim-up operation can be stopped at the right time regardless of size of the hull 12 and accordingly, it becomes possible to prevent the pitching which may occur due to excessive trim-up operation.

The apparatus and method further include an engine speed change amount calculator (ECU 110, S10, S112, S410) adapted to calculate a change amount DNE of the detected engine speed NE, and the second-speed changer changes the gear position from the first speed to the second speed when the detected engine speed NE is equal to or greater than the second predetermined speed NEa and the calculated change amount DNE of the engine speed is less than a prescribed value (first prescribed value) DNE1 (S10, S116, S132, S134, S416, S432, S434). With this, in addition to the above effects, it becomes possible to change the gear position to the second speed immediately after the acceleration through the torque amplification in the first speed is completed, thereby shortening a time period after the acceleration is completed until the boat speed reaches the maximum speed.

The apparatus and method further include a trim-down starter (ECU 110, S10, S14, S106, S164, S300, S304, S28, S406, S476, S1104, S1110) adapted to start the trim-down operation through the trim angle regulation mechanism 24 when the detected change amount DTH of the throttle opening is less than a second predetermined value (deceleration-determining predetermined value) DTHa; and a trim-down stopper (ECU 110, S14, S302, S306, S28, S1108, S1114) adapted to stop the trim-down operation when the trim angle θ becomes the initial angle after the trim-down operation is started by the trim-down starter. With this, it becomes possible to return the trim angle θ to the initial angle at the right time in accordance with the operating condition of the outboard motor 10.

In the second embodiment, the apparatus and method further include a trim angle regulation command outputter (power tilt-trim switch 130) adapted to output a regulation command of the trim angle θ upon manipulation by an operator; a first trim angle controller (automatic trim angle control; ECU 110, S10, S16 to S28) adapted to control operation of the trim angle regulation mechanism 24 based on transmission control through the transmission 46 so as to regulate the trim angle θ; a second trim angle controller (manual trim angle control; ECU 110, S24, S900) adapted to control the operation of the trim angle regulation mechanism 24 in response to the regulation command outputted from the trim angle regulation command outputter so as to regulate the trim angle θ; a trim angle determiner (ECU 110, S28, S1100) adapted to determine whether the trim angle θ becomes equal to or greater than a predetermined angle θ1 through control by the second trim angle controller when the regulation command is outputted from the trim angle regulation command outputter; and a trim angle regulation stopper (ECU 110, S28, S1116) adapted to stop regulation of the trim angle θ through the first trim angle controller when the trim angle θ is determined to be equal to or greater than the predetermined angle θ1.

Thus, it is configured to have the trim switch 130 that outputs the trim angle regulation command upon the manipulation by the operator and the second trim angle controller that controls the operation of the trim unit 24 in response to the trim angle regulation command to regulate the trim angle θ, and such that when the trim angle regulation command is outputted and it is determined by the second trim angle controller that the trim angle θ is equal to or greater than the predetermined angle θ1 (i.e., when the trim angle regulation command (trim-up command) is outputted by the operator to land the boat 1 and consequently the trim angle becomes the predetermined angle θ1 or more), the trim angle regulation through the first trim angle controller is stopped. With this, in addition to the above effects, when the boat 1 is to be landed, the trim angle regulation through the first trim angle controller is not implemented, more exactly, the outboard motor 10 can avoid being trimmed down to make the trim angle θ return to the initial angle through the first trim angle controller and it becomes possible to prevent the outboard motor 10 from interfering with the ground which may result in damage of the propeller 42, etc.

The apparatus and method further include a rudder angle detector (rudder angle sensor 106, ECU 110, S22, S800) adapted to detect a rudder angle α of the outboard motor 10 relative to the boat 1, and the first trim angle controller controls the operation of the trim angle regulation mechanism 24 to decrease the trim angle θ based on the detected rudder angle α when steering of the outboard motor 10 is started (S22, S804, S810, S816).

With this, in addition to the above effects, it becomes possible to prevent cavitation caused by steering of the outboard motor 10, so that the boat 1 can be smoothly turned. In the case where, for instance, the outboard motor 10 is steered with the maximum boat speed, since the thrust of the boat 1 is temporarily decreased, if the trim angle θ is maintained at the learning trim angle δ or ϵ, cavitation may occur. However, the trim angle θ is decreased based on the rudder angle α (the trim-down operation is conducted), it becomes possible to prevent cavitation and the boat 1 can be smoothly turned.

In the apparatus and method, the first trim angle controller controls the operation of the trim angle regulation mechanism 24 to increase the trim angle θ based on decrease in the detected rudder angle α after the steering is finished (S22, S804, S806). In other words, after the steering is finished, when the steering wheel 114 is returned to the initial position (position to make the boat 1 travel straight) through the manipulation by the operator and the rudder angle α is decreased accordingly, the trim angle θ is increased (the trim-up operation is conducted) in response to the decrease in the rudder angle α.

With this, in addition to the above effects, it becomes possible to return the trim angle θ to the learning trim angle δ or ϵ, thereby increasing the boat speed to again reach the maximum speed.

It should be noted that, although the outboard motor is exemplified above, this invention can be applied to an inboard/outboard motor equipped with a transmission and trim angle regulation mechanism.

It should also be noted that, although the deceleration/acceleration-determining predetermined values DTHa, DTHb, predetermined speeds NEa, NEb, NEc, NEd, predetermined angle θ1, displacement of the engine 30 and other values are indicated with specific values in the foregoing, they are only examples and not limited thereto.

Japanese Patent Application Nos. 2010-123286 and 2010-123291, both filed on May 28, 2010 are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising:

a throttle opening change amount detector adapted to detect a change amount of throttle opening of the engine;

an engine speed detector adapted to detect speed of the engine;

a first-speed changer adapted to change the gear position of the transmission from the second speed to the first speed when the gear position is in the second speed and the detected change amount of the throttle opening is equal to or greater than a predetermined value;

a trim-up starter adapted to start the trim-up operation through the trim angle regulation mechanism when the detected engine speed is equal to or greater than a first predetermined speed after the gear position is changed to the first speed by the first-speed changer;

a second-speed changer adapted to change the gear position from the first speed to the second speed when the detected engine speed is equal to or greater than a second predetermined speed set greater than the first predetermined speed after the trim-up operation is started by the trim-up starter; and a trim-up stopper adapted to stop the trim-up operation after the gear position is changed to the second speed by the second-speed changer.

2. The apparatus according to claim 1, further including:

an engine speed change amount calculator adapted to calculate a change amount of the detected engine speed, and the second-speed changer changes the gear position from the first speed to the second speed when the detected engine speed is equal to or greater than the second predetermined speed and the calculated change amount of the engine speed is less than a prescribed value.

3. The apparatus according to claim 1, further including:

a trim-down starter adapted to start the trim-down operation through the trim angle regulation mechanism when the detected change amount of the throttle opening is less than a second predetermined value; and a trim-down stopper adapted to stop the trim-down operation when the trim angle becomes the initial angle after the trim-down operation is started by the trim-down starter.

4. The apparatus according to claim 1, further including:

a trim angle regulation command outputter adapted to output a regulation command of the trim angle upon manipulation by an operator;

a first trim angle controller adapted to control operation of the trim angle regulation mechanism based on transmission control through the transmission so as to regulate the trim angle;

a second trim angle controller adapted to control the operation of the trim angle regulation mechanism in response to the regulation command outputted from the trim angle regulation command outputter so as to regulate the trim angle;

a trim angle determiner adapted to determine whether the trim angle becomes equal to or greater than a predetermined angle through control by the second trim angle controller when the regulation command is outputted from the trim angle regulation command outputter; and a trim angle regulation stopper adapted to stop regulation of the trim angle through the first trim angle controller when the trim angle is determined to be equal to or greater than the predetermined angle.

5. The apparatus according to claim 4, further including:

a rudder angle detector adapted to detect a rudder angle of the outboard motor relative to the boat, and the first trim angle controller controls the operation of the trim angle regulation mechanism to decrease the trim angle based on the detected rudder angle when steering of the outboard motor is started.

6. The apparatus according to claim 5, wherein the first trim angle controller controls the operation of the trim angle regulation mechanism to increase the trim angle based on decrease in the detected rudder angle after the steering is finished.

7. A method for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising the steps of:

detecting a change amount of throttle opening of the engine;

detecting speed of the engine;

changing the gear position of the transmission from the second speed to the first speed when the gear position is in the second speed and the detected change amount of the throttle opening is equal to or greater than a predetermined value;

starting the trim-up operation through the trim angle regulation mechanism when the detected engine speed is equal to or greater than a first predetermined speed after the gear position is changed to the first speed;

changing the gear position from the first speed to the second speed when the detected engine speed is equal to or greater than a second predetermined speed set greater than the first predetermined speed after the trim-up operation is started by the step of trim-up starting; and stopping the trim-up operation after the gear position is changed to the second speed.

8. The method according to claim 7, further including the steps of:

calculating a change amount of the detected engine speed, and the step of changing to the second speed changes the gear position from the first speed to the second speed when the detected engine speed is equal to or greater than the second predetermined speed and the calculated change amount of the engine speed is less than a prescribed value.

9. The method according to claim 7, further including the steps of:

starting the trim-down operation through the trim angle regulation mechanism when the detected change amount of the throttle opening is less than a second predetermined value; and stopping the trim-down operation when the trim angle becomes the initial angle after the trim-down operation is started by the step of trim-down starting.

10. The method according to claim 7, further including the steps of:

outputting a regulation command of the trim angle upon manipulation by an operator;

controlling operation of the trim angle regulation mechanism based on transmission control through the transmission so as to regulate the trim angle;

controlling the operation of the trim angle regulation mechanism in response to the regulation command outputted from the trim angle regulation command outputter so as to regulate the trim angle;

determining whether the trim angle becomes equal to or greater than a predetermined angle through control in response to the regulation command when the regulation command is outputted from the step of outputting; and stopping regulation of the trim angle based on the transmission control when the trim angle is determined to be equal to or greater than the predetermined angle.

11. The method according to claim 10, further including the step of:

detecting a rudder angle of the outboard motor relative to the boat, and the step of controlling based on the transmission control controls the operation of the trim angle regulation mechanism to decrease the trim angle based on the detected rudder angle when steering of the outboard motor is started.

12. The method according to claim 11, wherein the step of controlling based on the transmission control controls the operation of the trim angle regulation mechanism to increase the trim angle based on decrease in the detected rudder angle after the steering is finished.

* * * * *